US008011567B2

(12) United States Patent
DeBusk et al.

(10) Patent No.: US 8,011,567 B2
(45) Date of Patent: Sep. 6, 2011

(54) CARTONS WITH DISPENSER SECTIONS

(75) Inventors: Patrick James DeBusk, Larue, TX (US); Raymond Rudolph Spivey, Sr., Mableton, GA (US); Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 1044 days.

(21) Appl. No.: 11/374,738

(22) Filed: Mar. 14, 2006

(65) Prior Publication Data

US 2006/0231604 A1 Oct. 19, 2006

Related U.S. Application Data

(60) Provisional application No. 60/661,546, filed on Mar. 14, 2005.

(51) Int. Cl.
*B65D 17/00* (2006.01)
*B65D 65/00* (2006.01)
*B65D 75/00* (2006.01)

(52) U.S. Cl. ..... 229/235; 229/242; 229/240; 229/228; 229/230; 206/427

(58) Field of Classification Search ..... 229/235, 229/242, 240, 228, 230; 206/427
See application file for complete search history.

(56) References Cited

U.S. PATENT DOCUMENTS

| | | | | |
|---|---|---|---|---|
| 2,115,673 | A | 4/1938 | Stompe | |
| 2,547,892 | A * | 4/1951 | Stevens | 206/449 |
| 3,178,242 | A | 4/1965 | Ellis et al. | |
| 3,356,279 | A | 12/1967 | Root | |
| 3,904,036 | A * | 9/1975 | Forrer | 206/427 |
| 4,396,143 | A | 8/1983 | Killy | |
| 4,398,636 | A * | 8/1983 | Baxter | 229/242 |
| 4,417,655 | A | 11/1983 | Forbes, Jr. | |
| 4,577,762 | A | 3/1986 | Kuchenbecker | |
| 4,588,084 | A * | 5/1986 | Holley, Jr. | 206/427 |
| 4,634,007 | A * | 1/1987 | Rusnock | 229/205 |
| 4,676,430 | A * | 6/1987 | Wischusen et al. | 229/140 |
| 4,815,609 | A * | 3/1989 | Kiedaisch | 229/235 |
| 4,850,529 | A * | 7/1989 | Blackman | 229/120.31 |
| 4,890,440 | A | 1/1990 | Romagnoli | |
| 4,949,845 | A | 8/1990 | Dixon | |
| 4,974,771 | A | 12/1990 | Lavery | |
| 5,072,876 | A * | 12/1991 | Wilson | 229/103.2 |
| 5,137,211 | A | 8/1992 | Summer et al. | |
| 5,246,112 | A | 9/1993 | Stout et al. | |

(Continued)

FOREIGN PATENT DOCUMENTS

| | | |
|---|---|---|
| CN | 1303344 | 3/2001 |

(Continued)

OTHER PUBLICATIONS

Chinese Office Action for Application No. 200680008208.1 dated Jun. 5, 2009, for related Chinese application.

(Continued)

*Primary Examiner* — Gary E Elkins
*Assistant Examiner* — Latrice Byrd
(74) *Attorney, Agent, or Firm* — Womble Carlyle Sandridge & Rice, PLLC

(57) ABSTRACT

Cartons have dispenser sections that when opened, allow easy access to containers or other articles stored within the carton. The cartons can be configured to allow placement on a door shelf or other shelf within a refrigerator.

42 Claims, 19 Drawing Sheets

U.S. PATENT DOCUMENTS

| | | | | |
|---|---|---|---|---|
| 5,320,277 | A | 6/1994 | Stout et al. | |
| 5,360,113 | A | 11/1994 | Harris | |
| 5,505,372 | A | 4/1996 | Edson et al. | |
| 5,622,309 | A | 4/1997 | Matsuda et al. | |
| 5,664,683 | A | 9/1997 | Brody | |
| 5,690,213 | A | 11/1997 | Matsumura | |
| 5,704,470 | A | 1/1998 | Sutherland | |
| 5,826,783 | A | 10/1998 | Stout | |
| 5,875,961 | A | 3/1999 | Stone et al. | |
| 5,921,398 | A | 7/1999 | Carroll | |
| 5,924,559 | A | 7/1999 | Carrel et al. | |
| 6,155,480 | A | 12/2000 | Botsford et al. | |
| 6,176,419 | B1 | 1/2001 | Holley, Jr. | |
| 6,227,367 | B1 | 5/2001 | Harrelson et al. | |
| 6,402,021 | B1 * | 6/2002 | Heathcock | 229/242 |
| 6,409,077 | B1 | 6/2002 | Telesca et al. | |
| 6,631,803 | B2 | 10/2003 | Rhodes et al. | |
| 6,715,639 | B2 | 4/2004 | Spivey | |
| 6,752,262 | B1 | 6/2004 | Boriani et al. | |
| 6,832,683 | B2 * | 12/2004 | Boriani et al. | 206/273 |
| 6,834,793 | B2 | 12/2004 | Sutherland | |
| 6,866,186 | B2 | 3/2005 | Fogle et al. | |
| 7,066,379 | B2 * | 6/2006 | McLeod et al. | 229/120.26 |
| 7,204,406 | B2 * | 4/2007 | Bone | 229/242 |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2004/0060972 | A1 | 4/2004 | Harrelson | |
| 2004/0099558 | A1 | 5/2004 | Oliff et al. | |
| 2004/0238611 | A1 | 12/2004 | Sutherland | |

FOREIGN PATENT DOCUMENTS

| | | | |
|---|---|---|---|
| DE | 29 17 795 | | 8/1980 |
| DE | 202 06 462 | U1 | 9/2002 |
| EP | 0 475 147 | A1 | 3/1992 |
| EP | 1 262 417 | A2 | 12/2002 |
| FR | 2 441 550 | | 11/1978 |
| FR | 2 549 010 | A1 | 1/1985 |
| FR | 2 581 970 | | 11/1986 |
| GB | 1 420 024 | | 1/1976 |
| JP | 2002 2684 | A | 9/2002 |
| JP | 2004 2685 | A | 9/2002 |
| JP | 2003/511316 | | 3/2003 |
| JP | 2003/246319 | | 9/2003 |
| WO | WO 96/29260 | | 9/1996 |
| WO | WO 99/64301 | | 12/1999 |
| WO | WO 00/50308 | | 8/2000 |
| WO | WO 01/96205 | A1 | 12/2001 |
| WO | WO 02/30785 | A1 | 4/2002 |
| WO | WO 2004/002837 | A2 | 1/2004 |
| WO | WO 2004/043790 | A2 | 5/2004 |
| WO | WO 2005/080218 | A1 | 9/2005 |

OTHER PUBLICATIONS

Office action dated May 14, 2010 for related JP application 2008 501967.

* cited by examiner

CARTONS WITH DISPENSER SECTIONS

RELATED APPLICATIONS

This application claims the benefit of U.S. Provisional Application No. 60/661,546, filed on Mar. 14, 2005, the entire contents of which are hereby incorporated by reference as if presented herein.

BACKGROUND

Enclosed cartons with dispensing features have been used in the past. Many such cartons allow for the creation of dispenser openings by providing dispenser portions demarcated by tear lines. The dispenser portions can be wholly or partially separated from the carton to create an opening from which articles can be removed from the carton. Many conventional dispenser openings, however, provide insufficient access to containers accommodated within the carton. Other dispenser openings may provide sufficient access to containers within a carton, but the sections of the carton removed during opening of the dispenser portion compromise the structural integrity of the carton.

SUMMARY

According to one embodiment of the present invention, a carton comprises a bottom panel, a top panel, first and second side panels, and first and second end panels. A dispenser section is formed in the carton such that when the dispenser section is opened, a dispenser opening is formed at least in an upper portion of one side panel, the top panel, and an upper portion of a second side panel. Articles stored in the carton can be dispensed from the dispenser opening.

According to one aspect of the embodiment, when the dispenser section is opened, the opening provides easy access to containers or other articles accommodated within the carton. The end panels of the carton can remain intact after opening of the dispensing feature to allow easy carrying of the opened carton by handle apertures disposed in the end panels. Portions or substantially all of the upper portions of the side panels can be removed during opening to provide access to the articles from either one or both sides of the carton.

According to another embodiment of the present invention, a dispenser section is formed in a carton such that when the dispenser section is opened, a dispenser opening is formed in at least a portion of a first side panel, a top panel, a second side panel, and an end panel.

According to one aspect of the embodiment, the portion of the top panel of the carton removed during opening can be selected to provide access to a desired number of articles in the opened carton. The dispenser opening can extend down into the side panels to allow access from the sides of the carton, and can also extend into the end panel to allow access from the opened carton end. The sides and end of the opened carton can be sufficiently high to retain a high degree of structural rigidity for the carton. Handles can be formed in the carton ends that allow the carton to be carried after opening of the carton.

Other aspects, features, and details of the present invention can be more completely understood by reference to the following detailed description of exemplary embodiments taken in conjunction with the drawings and from the appended claims.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF TILE DRAWINGS

DETAILED DESCRIPTION

Figure 1:
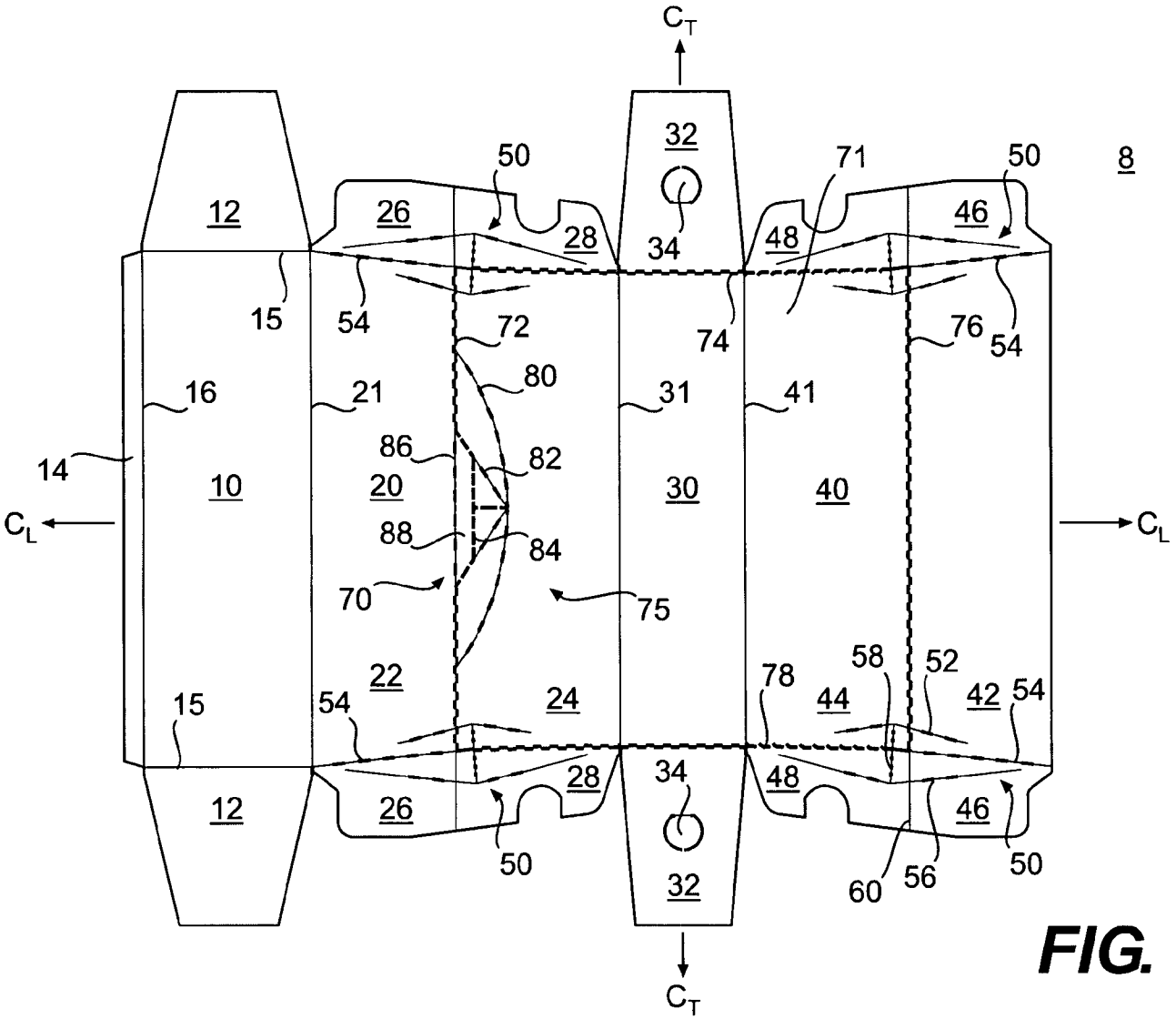
FIG. 1 is a plan view of a blank from which a carton having a dispenser section according to a first embodiment of the invention is formed.

The present invention generally relates to opening and dispensing features for cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

According to a first embodiment of the invention, illustrated by FIGS. 1-8, a dispenser opening is created in a carton 90 (illustrated in FIG. 4) by removing or at least partially separating an upper portion of a first side panel 20, a top panel 30, and an upper portion of a second side panel 40 of the carton 90. End panels 92, 94 of the carton 90 may remain intact to allow easy carrying of the opened carton by handles disposed in the end panels. When opened, the carton 90 provides easy access to articles from the top and from either side of the carton.

FIG. 1 is a plan view of a blank 8 used to form the carton 90 (illustrated in FIG. 4) according to the first embodiment of the invention. The blank 8 can be symmetric or partially symmetric about a longitudinal centerline $C_L$ and about a transverse centerline $C_T$. Therefore, certain elements in the drawing figures have similar or identical reference numerals in order to reflect the whole or partial longitudinal and/or transverse symmetries. As shown in FIG. 1, the blank 8 comprises a glue flap 14 foldably connected to a rectangular bottom panel 10 at a first transverse fold line 16. The bottom panel 10 is foldably connected to the first side panel 20 at a second transverse fold line 21, the top panel 30 is foldably connected to the first side panel 20 at a third transverse fold line 31, and the second side panel 40 is foldably connected to the top panel 30 at a fourth transverse fold line 41. Oppositely disposed bottom end flaps 12 are foldably connected to the bottom panel 10 at longitudinal fold lines 15. Oppositely disposed top end flaps 32 are foldably connected to the top panel 30 at longitudinal fold lines 74, 78. Circular handle apertures 34 can be included in the top end flaps 32.

The first side panel 20 comprises a first upper side panel 24 and a first lower side panel 22 foldably connected at a transverse fold line 72 which may be partially interrupted at a section 86. Oppositely disposed end flaps 28 are foldably connected to the first upper side panel 24 at the longitudinal fold lines 74, 78. Similarly, oppositely disposed end flaps 26 are foldably connected to the first lower side panel 22 at oblique fold lines 54. The second side panel 40 can comprise a second upper side panel 44 and a second lower side panel 42 foldably connected at a transverse fold line 76. Oppositely disposed end flaps 48 are foldably connected to the second upper side panel 44 at the longitudinal fold lines 74, 78. Similarly, oppositely disposed end flaps 46 are foldably connected to the second lower side panel 42 at the oblique fold lines 54. The longitudinal fold lines 15, 74, 78 and the oblique fold lines 54 may be straight fold lines, or may be offset at one or more locations to account for, for example, blank thickness.

The blank 8 includes four diamond corners 50. Two are formed in the first upper side panel 24, the first lower side panel 22, and the end flaps 26, 28; these two diamond corners 50 are located at opposite ends of the first side panel 20. Similarly, two diamond corners 50 are formed in the second upper side panel 44, the second lower side panel 42, and the end flaps 46, 48; these two diamond corners 50 are located at opposite ends of the second side panel 40. At each of these locations, the diamond corners 50 are defined in part by transverse fold lines 58, 60, V-shaped fold lines 52, 56, and the oblique fold line 54.

Figure 4:
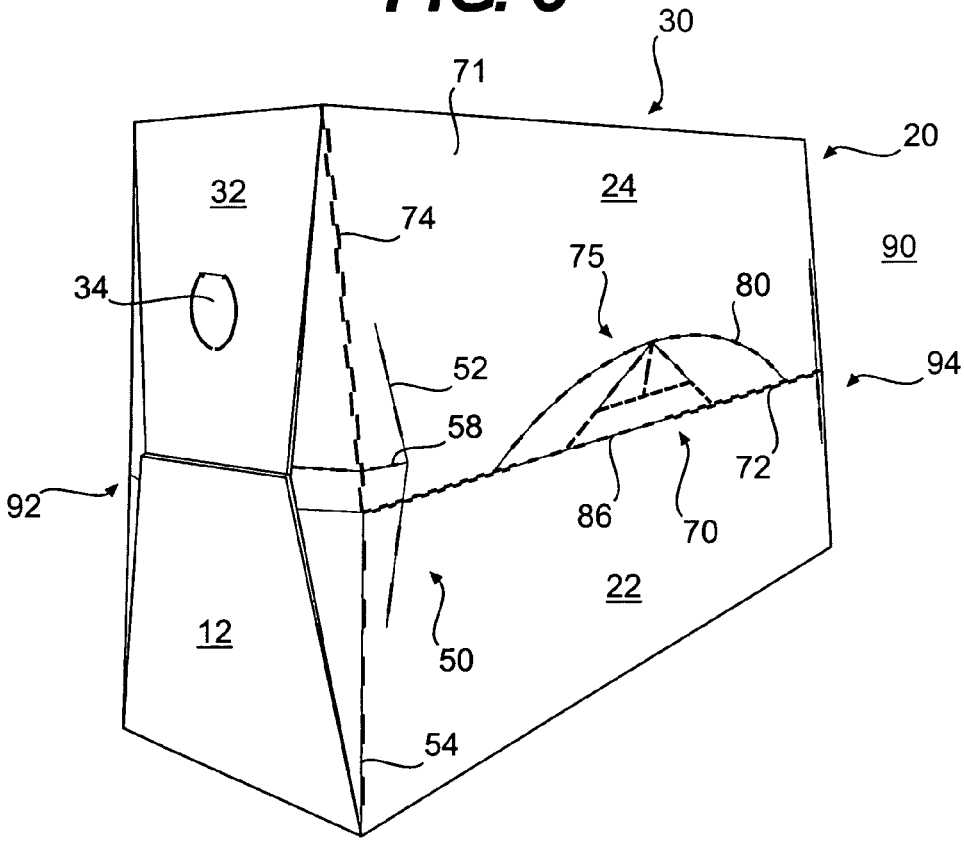
FIG. 4 is a perspective view showing one side of the first carton embodiment.

According to one aspect of this embodiment, a dispenser pattern 70 formed in the blank 8 defines a dispenser section 71. The dispenser pattern 70 can generally comprise a pattern of lines of disruption in the blank 8 that allow the dispenser section 71 to remain hingedly attached or to be completely removed from the carton 90 (FIG. 4). The dispenser pattern 70 may comprise, for example, tear lines that extend along the transverse fold lines 72, 76 and the longitudinal fold lines 74, 78. The dispenser pattern 70 may also define an opening section or flap 75 within the dispenser section 71. The opening flap 75 is located in the first upper side panel 24 adjacent to the lower side panel 22. The opening flap 75 may be defined by a curved opening line 80, a V-shaped opening line 82, an inverted T-shaped opening line 84, and the section 86 of the transverse fold line 72. The tear line in the transverse fold line 72 extends across the length of the first side panel 20 and the tear line in the transverse fold line 76 extends across the length of the second side panel 40. A trapezoidal panel 88 can be defined in the opening flap 75 adjacent to the section 86 of the transverse fold line 72.

The lines that comprise the opening flap 75 can be lines of disruption designed to provide easy access or entry into the opening flap 75. For example, the lines 84 can be tear lines designed to break upon pressing on the opening flap 75. The lines 80, 82 and 86 can be lines designed to flex or deform upon pressing on the opening flap 75, which allows a user to obtain a firm grasp on the flap 75. In the illustrated embodiment, the opening line 84 is a cut/space line, and the lines 80, 82, 86 are cut/crease lines.

Figure 2:
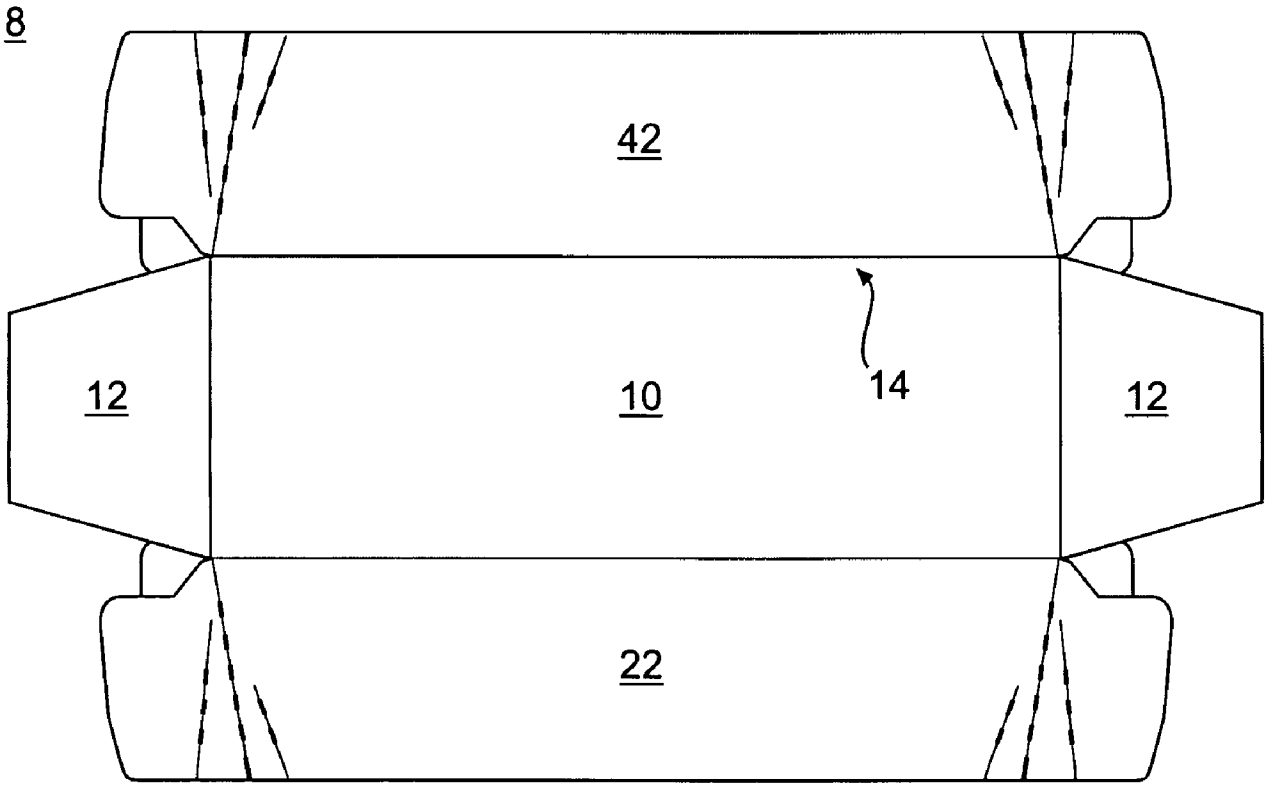
FIG. 2 is a plan view of a folded and glued blank from which the first carton embodiment is formed.

An exemplary method of erection of the carton 90 from the blank 8 will now be discussed with reference to FIGS. 2-5. FIG. 2 illustrates the blank 8 in a partially erected state with the print side or exterior side of the blank 8 facing out. The blank 8 is folded 180° about the transverse fold line 72, and the second lower side panel 42 also is folded 180° about the transverse fold line 76. The second lower side panel 42 overlaps the glue flap 14 and is adjacent the bottom panel 10. Referring also to FIG. 1, the second lower side panel 42 is adhered or secured to the glue flap 14 by glue, adhesive, or other means known within the art.

Figure 3:
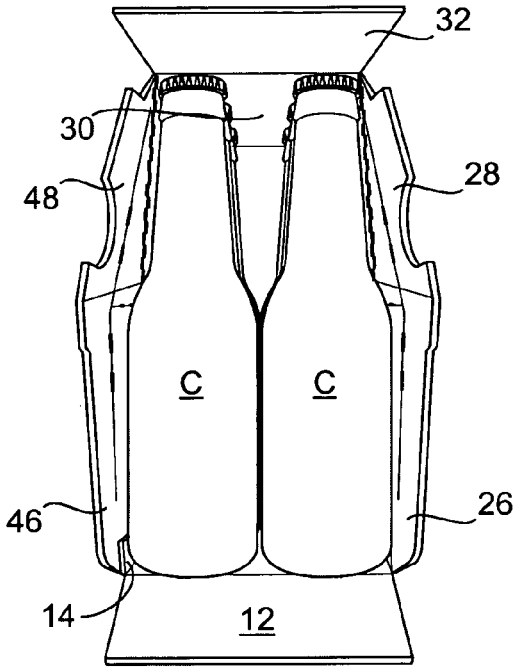
FIG. 3 is an end view of the first carton embodiment partially erected and filled with containers.

FIG. 3 illustrates the blank 8 of FIG. 2 opened into a partially assembled carton loaded with containers C arranged in a 2×6 orientation. Articles such as, for example, the containers C may be loaded into the partially assembled carton in a conventional manner at any time before one or both ends of the carton are closed by the end flaps 12, 26, 28, 32, 46, 48.

Figure 5:
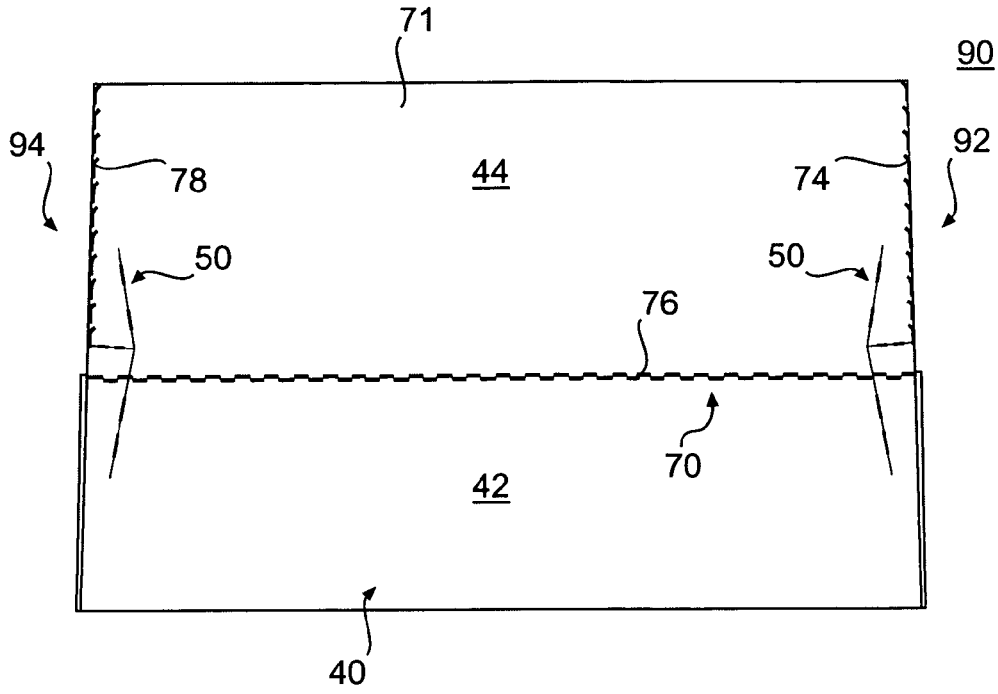
FIG. 5 illustrates the opposite side of the first carton embodiment.

FIG. 4 is a perspective view of one side of the erected carton 90. FIG. 5 is a front elevational view of the opposite side of the erected carton 90. Referring also to FIG. 3, the ends of the carton 90 may be formed by folding inwardly and gluing or otherwise adhering the end flaps 12, 26, 28, 32, 46, 48 to form the first end panel 92 and the second end panel 94 at first and second ends of the carton 90, respectively. FIG. 4 illustrates the location of the dispenser pattern 70 including the opening flap 75 on the first side panel 20 of the erected carton 90. FIG. 5 illustrates the second side panel 40 and the tear lines of the dispenser pattern 70 that extend along the transverse fold line 76 and the fold lines 74, 78.

Figure 6:
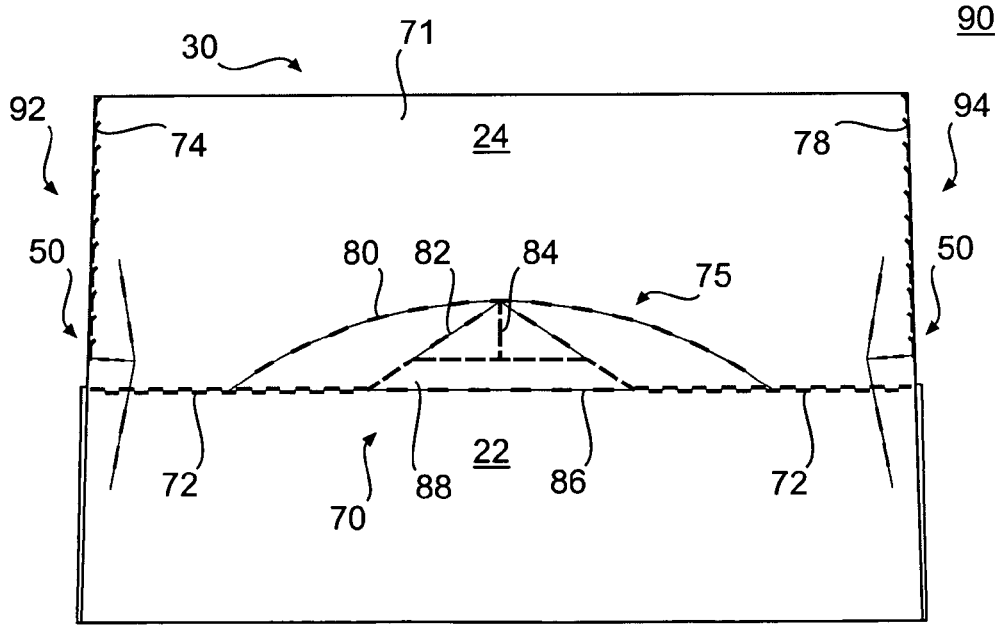
FIG. 6 illustrates the side of the carton opposite to that shown in FIG. 5.

FIG. 6 illustrates the opening flap 75 of the dispenser section 71 in detail. The curved opening line 80 defines an upper perimeter of the opening flap 75, and can extend across a significant portion of the width of the carton 90. The transverse fold line 72 defines a lower edge of the opening flap 75. The V-shaped opening line 82, the inverted T-shaped opening line 84 and the section 86 define the trapezoidal panel 88.

One exemplary method of opening of the carton 90 will now be discussed with reference to FIGS. 6-8. Referring to FIG. 6, a user can breach one or more of lines 80, 82, 84, 72, optionally including the section 86 of the transverse fold line 72, in the opening flap 75 with his fingers in order to obtain a grasp of the dispenser section 71. In the exemplary embodiment, the opening flap 75 is primarily breached at the opening line 84, although other lines of the opening flap 75 may be torn to varying degrees. If the section 86 of the transverse fold line 72 is torn completely when the opening flap 75 is breached, the trapezoidal panel 88 will separate with the dispenser section 71. Otherwise, the trapezoidal panel 88 can remain attached to the first lower side panel 22.

Figure 7:
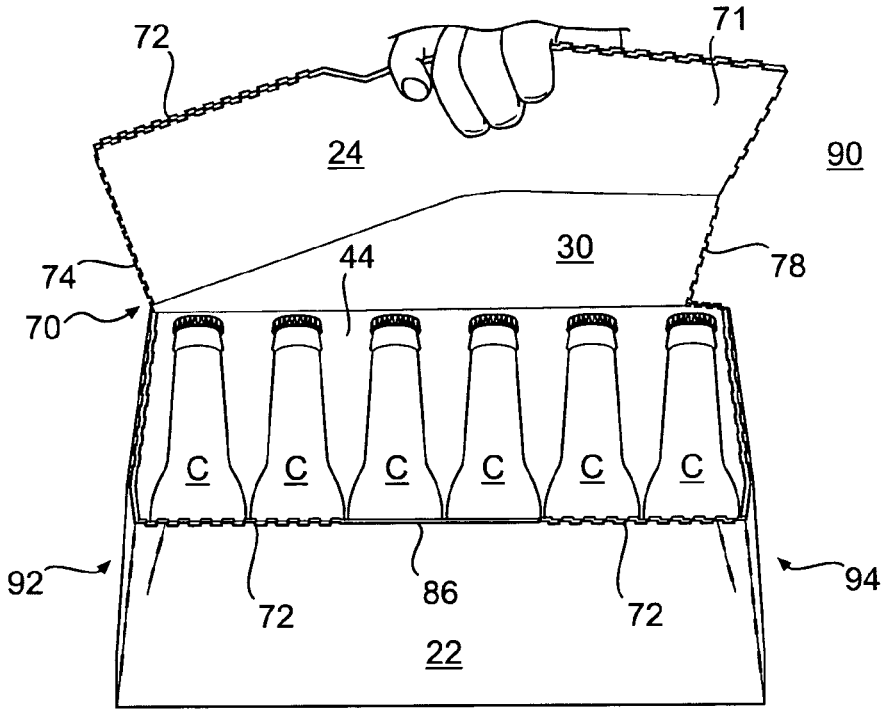
FIG. 7 illustrates opening of the first carton embodiment.

Referring to FIG. 7, after the opening flap 75 has been breached, the dispenser section 71 is pulled vertically away from the first lower side panel 22, and the carton 90 tears open along the dispenser pattern 70. That is, the first upper side panel 24 is torn away from the first lower side panel 22 along the transverse fold line 72, and the section 86 if applicable. Once the fold line 72 is torn across the length of the carton 90, the first upper side panel 24 may be pulled vertically along the longitudinal fold lines 74, 78 to disengage the first upper side panel 24 from the first end panel 92 and the second end panel 94, respectively. Opening along the dispenser pattern 70 continues along the longitudinal fold lines 74, 78 as the top panel 30 and then the second upper side panel 44 are torn away from the first and second end panels 92, 94. Once the transverse fold line 76 is reached, the dispenser section 71 can be left to remain hingedly attached to the carton 90 (not shown). Alternatively, the second upper side panel 44 of the dispenser section 71 may be pulled horizontally, removing the dispenser section 71 from the remainder of the carton 90 along the upper edge of the second lower side panel 42.

Figure 8:
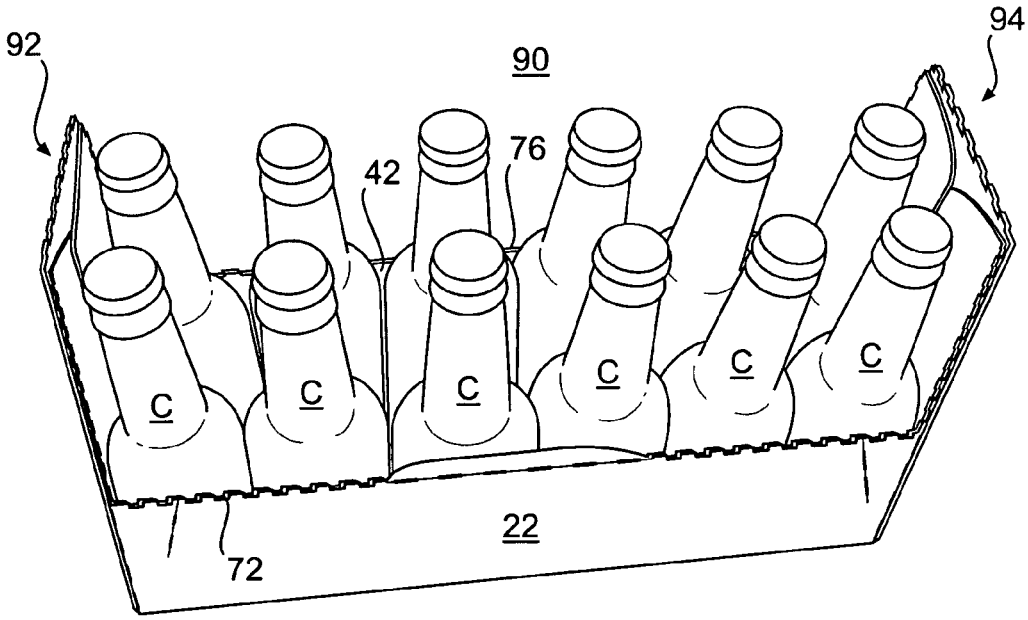
FIG. 8 is a perspective view of the opened first carton embodiment.

FIG. 8 illustrates the opened carton 90 with the dispenser section 71 completely removed from the remainder of the carton 90. The opened carton 90 allows access to and visibility of the containers C from both sides and from the top of the carton 90. The first and second end panels 92, 94 of the carton 90 remain to allow easy carrying of the opened carton 90 by the handles 34 disposed in the end panels. The first carton embodiment can be, for example, stored inside a refrigerator, and provides easy access to, for example, glass or plastic beverage bottles. The exemplary 2×6 container configuration generally will allow the carton 90 to be placed and stored in a door shelf of a refrigerator, if desired. Optionally, the carton 90 can be placed on another shelf in the refrigerator or on another surface, where the carton provides easy access to articles from either side and/or from the top of the carton.

According to a second embodiment of the invention, illustrated by FIGS. 9-13, a dispenser opening is created in a carton 190 by removing or at least partially separating a section of a second side panel 140, a top panel 130, and an upper portion of a first side panel 120 of the carton 190. The section of the second side panel 140 that remains with the carton 190 provides additional stability to the carton. When opened, the carton 190 provides easy access to articles from the top and the open side of the carton.

Figure 9:
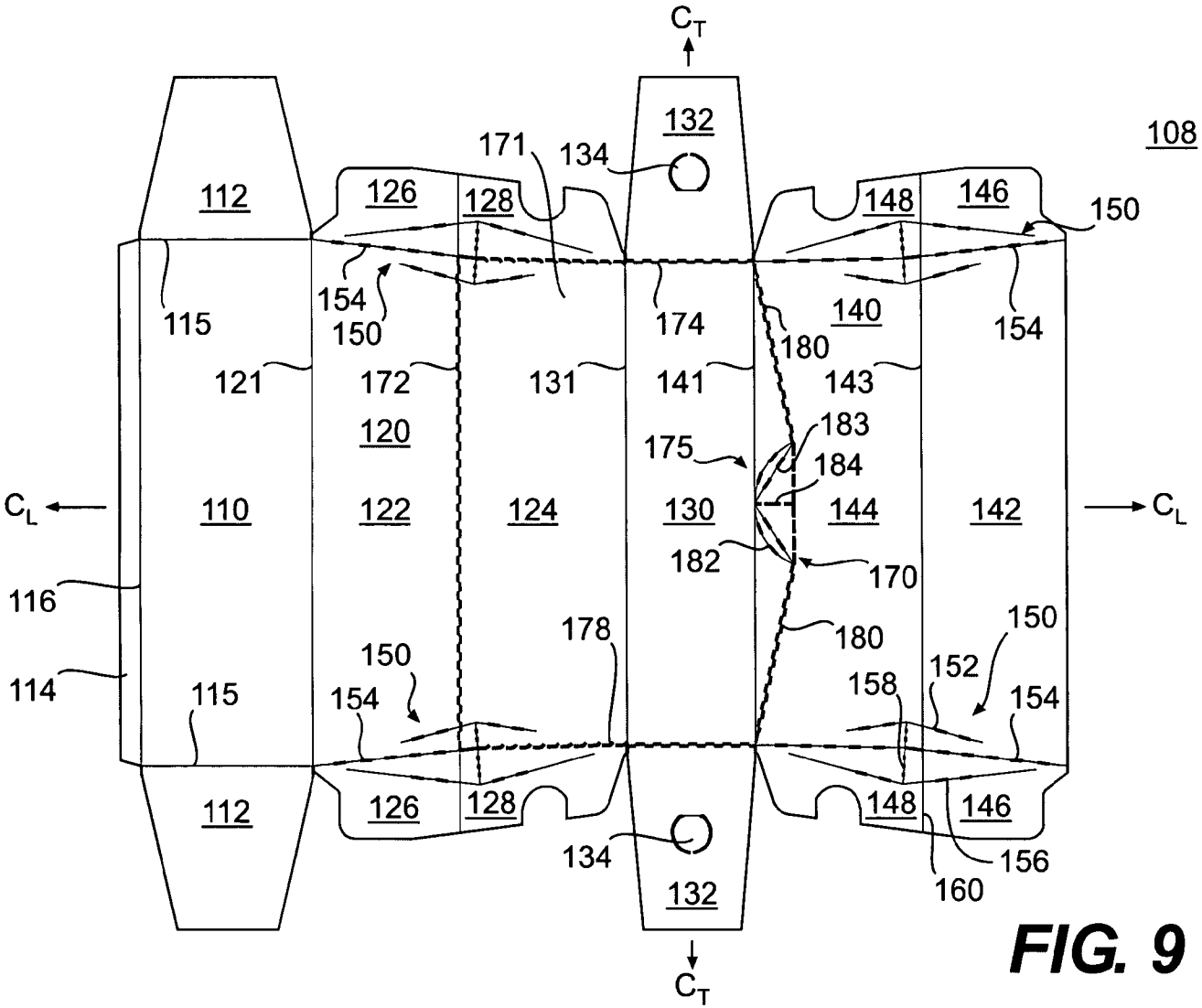
FIG. 9 is a plan view of a blank from which a carton having a dispenser section according to a second embodiment of the invention is formed.

FIG. 9 is a plan view of a blank 108 used to form the carton 190 (illustrated in FIG. 10) according to the second embodiment of the invention. The blank 108 can be symmetric or partially symmetric about a longitudinal centerline $C_L$ and about a transverse centerline $C_T$. Therefore, certain elements in the drawing figures have similar or identical reference numerals in order to reflect the whole or partial longitudinal and/or transverse symmetries. As shown in FIG. 9, the blank 108 comprises a glue flap 114 foldably connected to a rectangular bottom panel 110 at a first transverse fold line 116. The bottom panel 110 is foldably connected to the first side panel 120 at a second transverse fold line 121, the top panel 130 is foldably connected to the first side panel 120 at a third transverse fold line 131, and the second side panel 140 is foldably connected to the top panel 130 at a fourth transverse fold line 141. Oppositely disposed bottom end flaps 112 are foldably connected to the bottom panel 110 at longitudinal fold lines 115. Oppositely disposed top end flaps 132 are foldably connected to the top panel 130 at longitudinal fold lines 174, 178. Circular handle apertures 134 can be included in the top end flaps 132.

The first side panel 120 can comprise a first upper side panel 124 and a first lower side panel 122 foldably connected at a transverse fold line 172. Oppositely disposed end flaps 128 are foldably connected to the first upper side panel 124 at the longitudinal fold lines 174, 178. Similarly, oppositely disposed end flaps 126 are foldably connected to the first lower side panel 122 at oblique fold lines 154. The second side panel 140 can comprise a second upper side panel 144 and a second lower side panel 142 foldably connected at a transverse fold line 143. Oppositely disposed end flaps 148 are foldably connected to the second upper side panel 144 at the oblique fold lines 154. Similarly, oppositely disposed end flaps 146 are foldably connected to the second lower side panel 142 at the oblique fold lines 154. The longitudinal fold lines 115, 174, 178 and the oblique fold lines 154 may be straight fold lines, or may be offset at one or more locations to account for, for example, blank thickness.

The blank 108 includes four diamond corners 150. Two are formed in the first upper side panel 124, the first lower side panel 122, and the end flaps 126, 128; these two diamond corners 150 are located at opposite ends of the first side panel 120. Similarly, two diamond corners 150 are formed in the second upper side panel 144, the second lower side panel 142, and the end flaps 146, 148; these two diamond corners 150 are located at opposite ends of the second side panel 140. At each of these locations, the diamond corners 150 are defined in part by transverse fold lines 158, 160, V-shaped fold lines 152, 156, and the oblique fold lines 154.

According to one aspect of the second embodiment, a dispenser pattern 170 formed in the blank 108 defines a dispenser section 171. The dispenser pattern 170 can generally comprise a pattern of lines of disruption in the blank 108 that allow the dispenser section 171 to remain hingedly attached to or to be completely removed from the carton (illustrated in FIG. 10). The dispenser pattern 170 may comprise, for example, tear lines that extend along the transverse fold line 172 and the longitudinal fold lines 174, 178. The dispenser pattern 170 also defines an opening section or flap 175 within the dispenser section 171. The opening flap 175 is located near the top of the second upper side panel 144 adjacent to the top panel 130. The opening flap 175 may be defined by oblique opening lines 180, a curved opening line 182, a V-shaped opening line 183, and a T-shaped opening line 184.

The lines that comprise the opening flap 175 can be lines of disruption designed to provide easy access or entry into the opening flap 175. For example, the line 184 can be a tear line designed to break upon pressing on the opening flap 175. The lines 182, 183 can be lines designed to flex or deform upon pressing and breaching the opening flap 175, which allows a user to obtain a firm grasp on the opening flap 175. The oblique opening lines 180 may be tear lines that allow the dispenser section 171 to initially tear along the second side panel 140.

Figure 10:
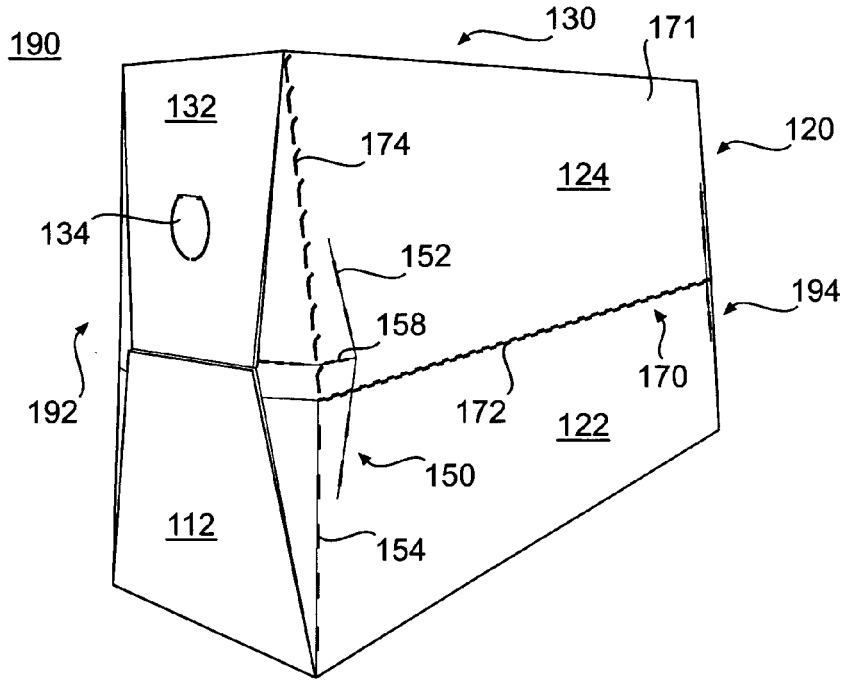
FIG. 10 is a perspective view showing one side of the second carton embodiment.
Figure 11:
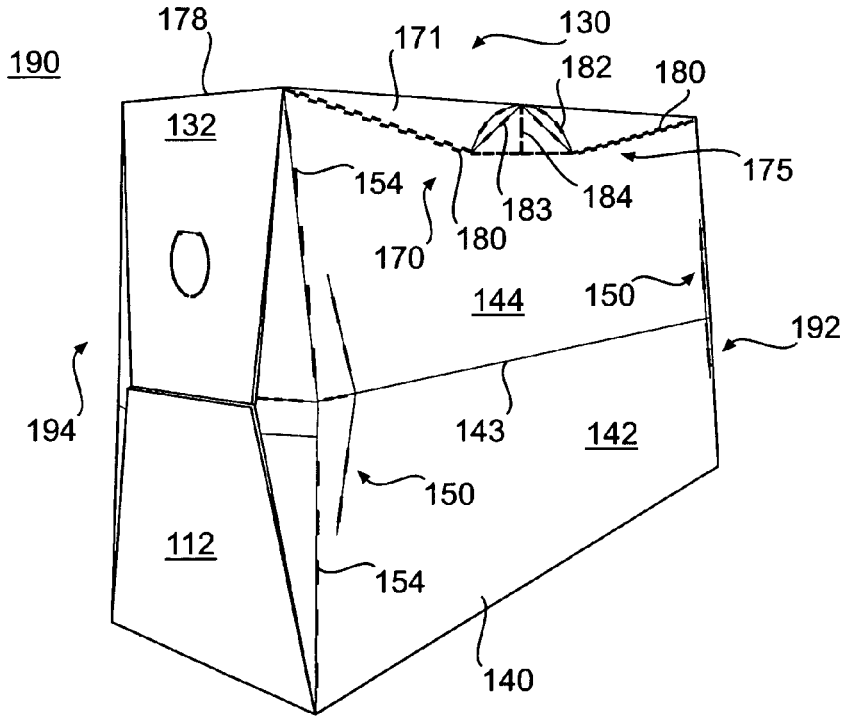
FIG. 11 illustrates the opposite side of the second carton embodiment.

The exemplary method discussed above for erecting the carton 90 of the first embodiment from the blank 8 can be employed to erect the carton 190 of the second embodiment. With reference to FIGS. 9-11, the method for erecting the carton 190 from the blank 108 can be summarized as follows: With the print or exterior side of the blank 108 facing out, the blank 108 is folded 180° about the transverse fold line 172, and the second lower side panel 142 also is folded 180° about the transverse fold line 143. The second lower side panel 142 overlaps the glue flap 114 and is adjacent the bottom panel 110. The second lower side panel 142 is adhered or otherwise secured to the glue flap 114 by glue, adhesive, or other means known within the art.

FIG. 10 is a perspective view of one side of the erected carton 190, and FIG. 11 is a perspective view of the opposite side of the carton 190. The carton 190 is filled with containers C (not visible in FIGS. 10 and 11) arranged in a 2×6 orientation. The ends of the carton 190 may be closed by folding inwardly and gluing or otherwise adhering the end flaps 112, 126, 128, 132, 146, 148 (illustrated in FIG. 9) to form a first end panel 192 and a second end panel 194 at each end of the carton 190. Articles may be loaded into the partially assembled carton in a conventional manner at any time before one or both ends of the carton 190 are closed by the end flaps 112, 126, 128, 132, 146, 148.

Referring to FIG. 10, the tear lines of the pattern 170 extend along the transverse fold line 172, which is located in the first side panel 120. FIG. 11 is a view of the opposite side of carton 190, and illustrates the location of the opening flap 175 near the top of the second upper side panel 144. The bottom edge of the opening flap 175 is defined by the oblique opening lines 180 and the T-shaped line 184.

An exemplary method of opening of the carton 190 will now be discussed with reference to FIGS. 10-12. Referring to FIGS. 10 and 11, a user can breach one or more of the lines 182, 183, 184 in the opening flap 175 with his fingers in order to grasp the dispenser section 171. After the opening flap 175 has been breached, the dispenser section 171 is torn vertically away from the second upper side panel 144 along the oblique opening tear lines 180. Opening along the dispenser pattern 170 continues along the tear lines in the longitudinal fold lines 174, 178 as the top panel 130 and the first upper side panel 124 are separated from the first and second end panels 192, 194. Once the transverse fold line 172 is reached, the dispenser section 171 can remain hingedly attached to the carton 190 (not illustrated). Alternatively, the first upper side panel 124 of the disperser section 171 may be pulled horizontally, removing the dispenser section 171 from the first lower side panel 122 and the carton 190, as shown in FIG. 12.

Figure 12:
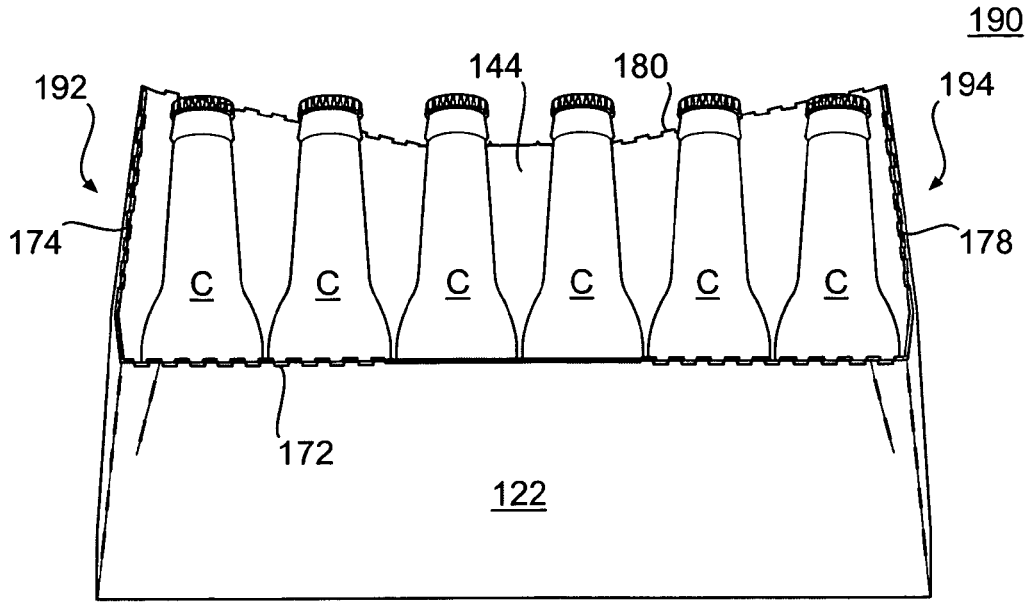
FIG. 12 illustrates one side of the second carton embodiment after opening of the carton.
Figure 13:
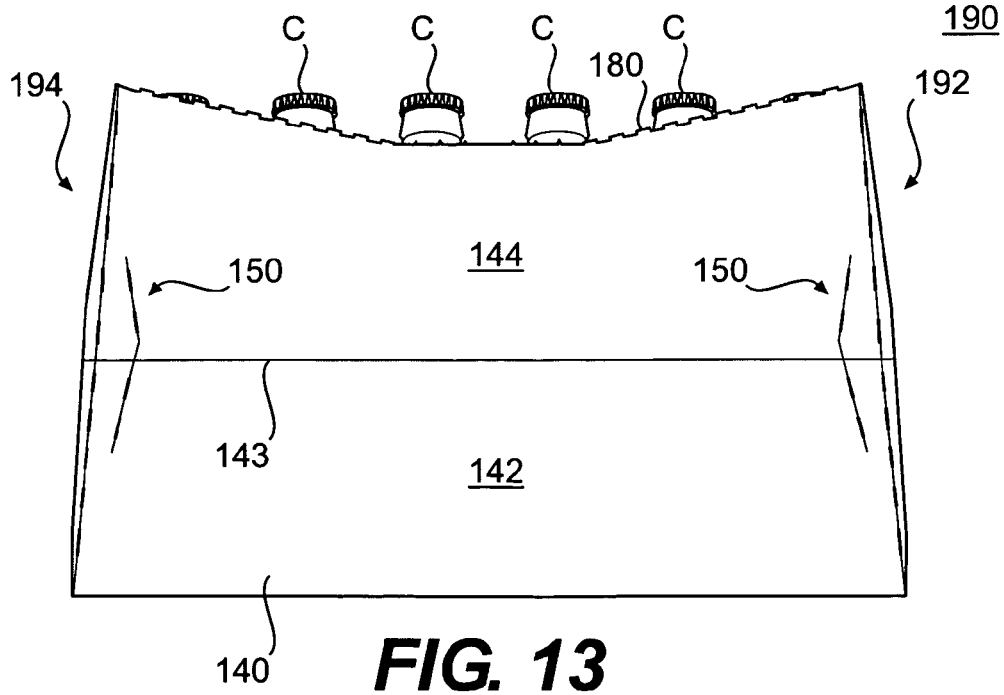
FIG. 13 illustrates the opposite side of the opened second carton embodiment.

FIGS. 12-13 illustrate the opened carton 190 with the dispenser section 171 removed. From the open or dispensing side of the carton 190 shown in FIG. 12, the containers C are readily accessible above the first lower side panel 122. FIG. 13 illustrates the opposite side of the carton 190, where the second upper side panel 144 remains intact up to the lower edge of the removed opening flap 175.

After the dispenser section 171 is removed, the carton 190 allows both visibility of the containers C and easy access to the containers C, from the open side and from the top of the carton 190. The section of the second side panel 140 that remains with the carton 190 provides additional stability to the carton 190. The end panels 192, 194 of the carton 190 may remain to allow easy carrying of the opened carton 190 by the handles 134. The carton 190 can be stored inside a refrigerator, for example, and provides easy access to, for example, glass or plastic beverage bottles. According to one aspect of the present embodiment, the 2×6 configuration generally will allow the carton 190 to be stored in a door shelf of a refrigerator, if desired.

According to a third embodiment of the invention, illustrated by FIGS. 14-18, a dispenser opening is created in a carton 290 by removing or at least partially separating an upper portion of a first side panel 220, a top panel 230, and an upper portion of a second side panel 240 of the carton 290. When opened, the carton 290 provides easy access to articles from the top and from either side of the carton.

Figure 14:
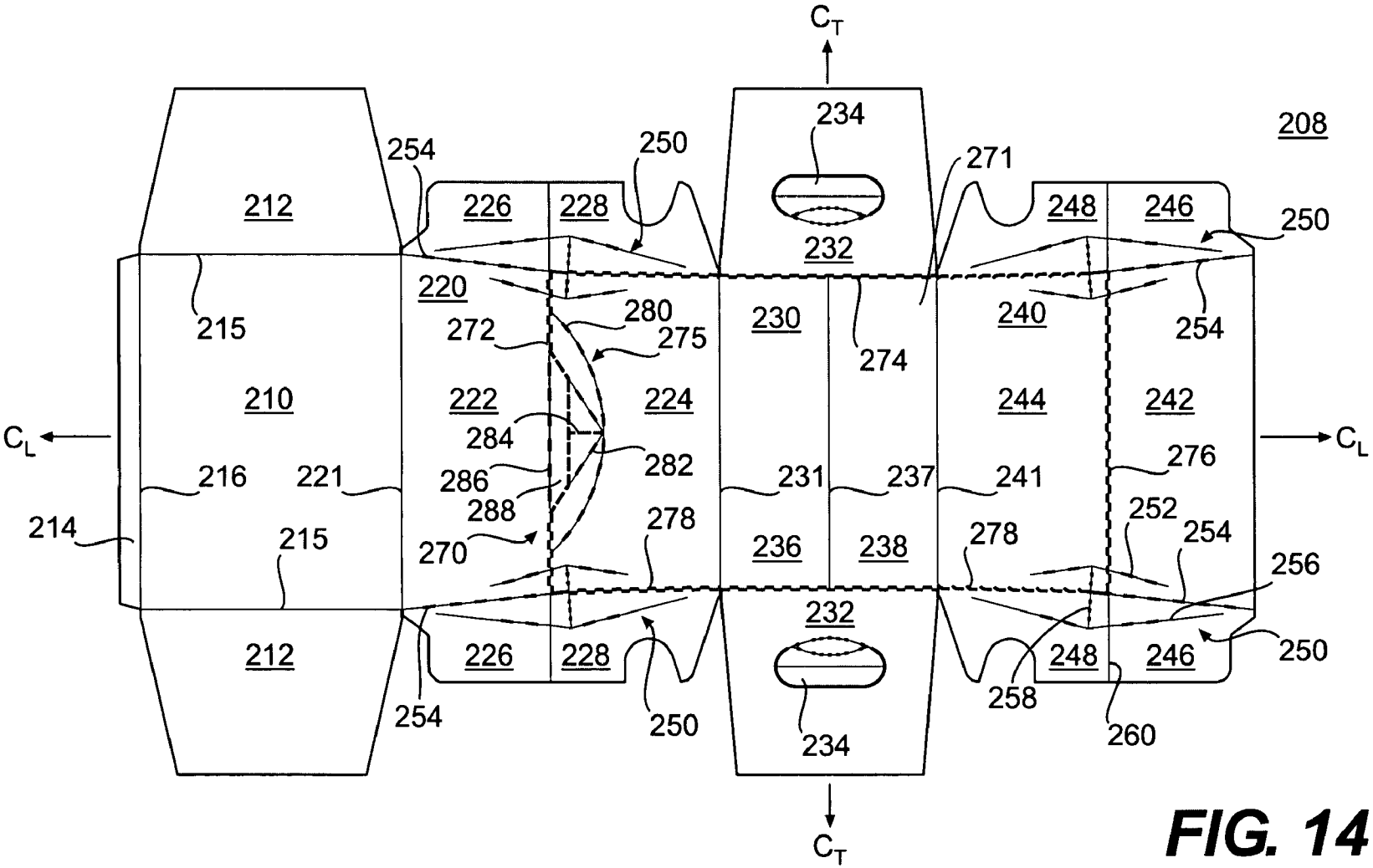
FIG. 14 is a plan view of a blank from which a carton having a dispenser section according to a third embodiment of the invention is formed.

FIG. 14 is a plan view of a blank 208 used to form the carton 290 (illustrated in FIG. 15) according to the third embodiment of the invention. As shown in FIG. 14, the blank 208 comprises a glue flap 214 which is foldably connected to a rectangular bottom panel 210 at a first transverse fold line 216. The bottom panel 210 is foldably connected to the first side panel 220 at a second transverse fold line 221, the top panel 230 is foldably connected to the first side panel 220 at a third transverse fold line 231, and the second side panel 240 is foldably connected to the top panel 230 at a fourth transverse fold line 241. Oppositely disposed bottom end flaps 212 are foldably connected to the bottom panel 210 at longitudinal fold lines 215. Oppositely disposed top end flaps 232 are foldably connected to the top panel 230 at longitudinal fold lines 274, 278. Handle apertures 234 can be included in the top end flaps 232. The top panel 230 also can comprise a first side top panel 236 and a second side top panel 238 foldably connected at a transverse fold line 237.

The first side panel 220 can comprise a first upper side panel 224 and a first lower side panel 222 foldably connected at a transverse fold line 272 which has a section 286. Oppositely disposed end flaps 228 are foldably connected to the first upper side panel 224 at the longitudinal fold lines 274, 278. Similarly, oppositely disposed end flaps 226 are foldably connected to the first lower side panel 222 at oblique fold lines 254. The second side panel 240 can comprise a second upper side panel 244 and a second lower side panel 242 foldably connected at a transverse fold line 276. Oppositely disposed end flaps 248 are foldably connected to the second upper side panel 244 at the longitudinal fold lines 274, 278. Similarly, oppositely disposed end flaps 246 are foldably connected to the second lower side panel 242 at the oblique fold lines 254. The longitudinal fold lines 215, 274, 278 and the oblique fold lines 254 may be straight fold lines, or may be offset at one or more locations to account for, for example, blank thickness.

The blank 208 includes four diamond corners 250. Two are formed in the first upper side panel 224, the first lower side panel 222, and the end flaps 226, 228; these two diamond corners 250 are located at opposite ends of the first side panel 220. Similarly, two diamond corners 250 are formed in the second upper side panel 244, the second lower side panel 242, and the end flaps 246, 248; these two diamond corners 250 are located at opposite ends of the second side panel 240. At each of these locations, the diamond corners 250 are defined in part by transverse fold lines 258, 260, V-shaped fold lines 252, 256, and the oblique fold line 254.

According to one aspect of the present embodiment, a dispenser pattern 270 formed in the blank 208 defines a dispenser section 271. The dispenser pattern 270 can generally comprise a pattern of lines of disruption in the blank 208 that allow the dispenser section 271 to remain hingedly attached or to be completely removed from the carton 290 (illustrated in FIG. 15). The dispenser pattern 270 may comprise, for example, tear lines that extend along the transverse fold lines 272, 276 and the longitudinal fold lines 274, 278. The dispenser pattern 270 also defines an opening section or flap 275 within the dispenser section 271. The opening flap 275 is located in the first upper side panel 224 adjacent to the lower side panel 222, and can be generally similar in shape, construction and function to the opening flap 75 illustrated in FIG. 1. The opening flap 275 may be defined by a curved opening line 280, a V-shaped opening line 282, an inverted T-shaped opening line 284, and the section 286 of the transverse fold line 272. The tear line in the transverse fold line 272 extends across the length of the first side panel 220, and the tear line in the transverse fold line 276 extends across the length of the second side panel 240. A trapezoidal panel 288 can be defined in the opening flap 275 adjacent to the section 286 of the transverse fold line 272.

Figure 15:
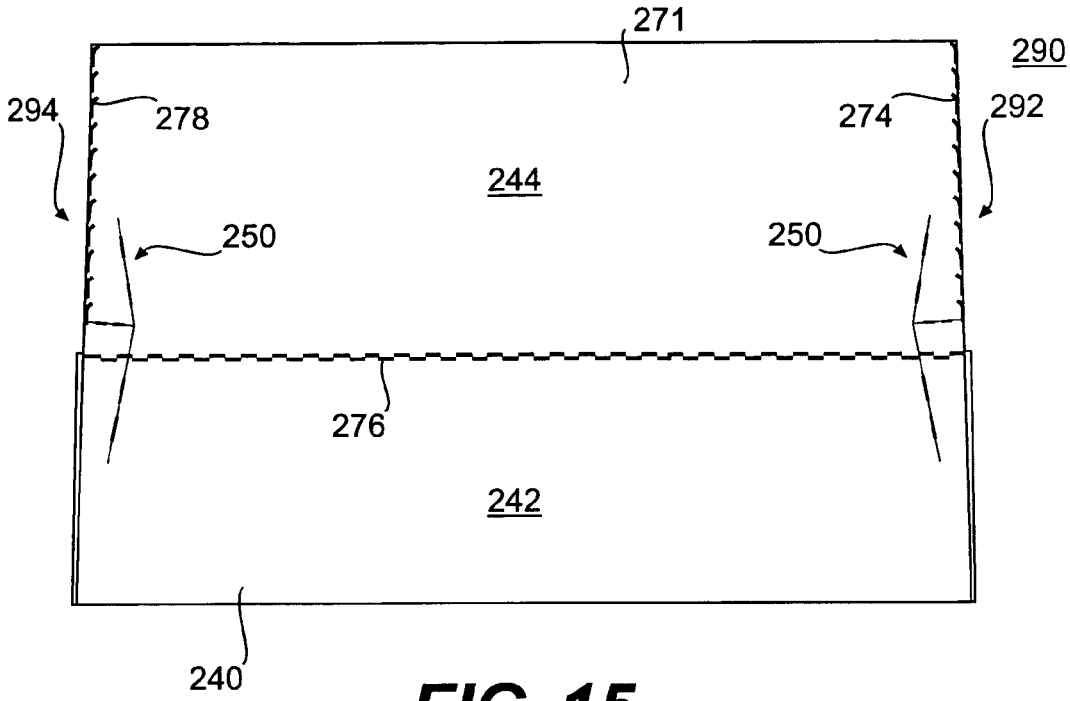
FIG. 15 illustrates one side of the third carton embodiment.
Figure 16:
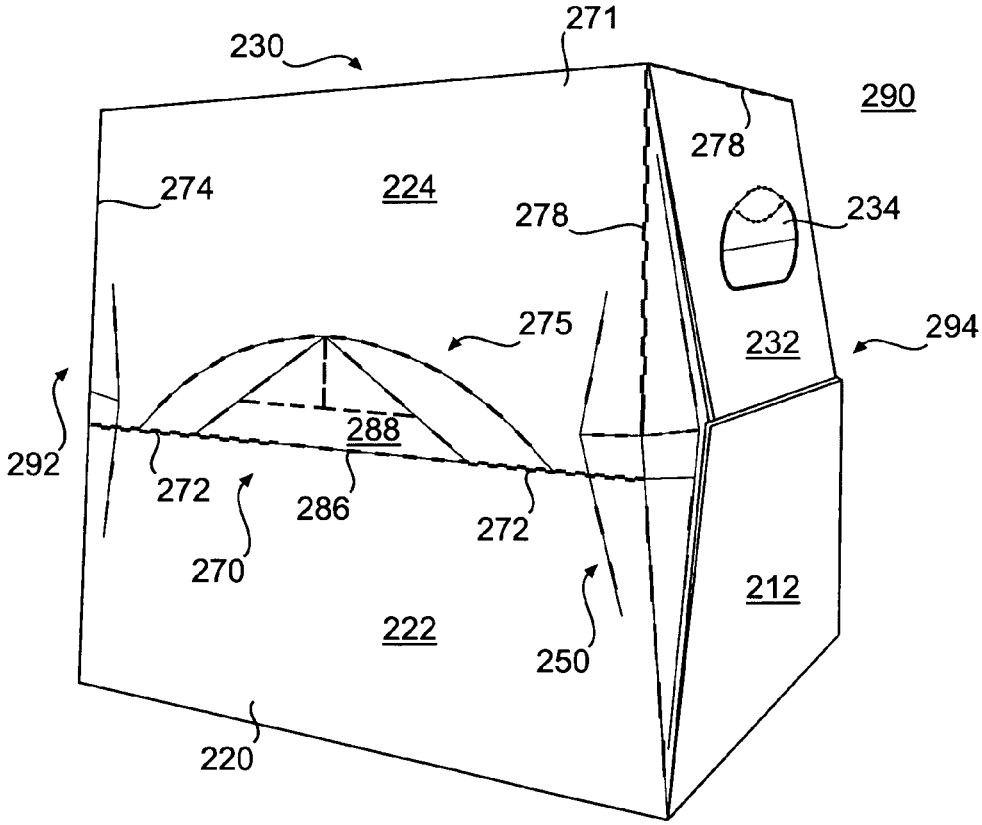
FIG. 16 illustrates the opposite side of the third carton embodiment.
Figure 17:
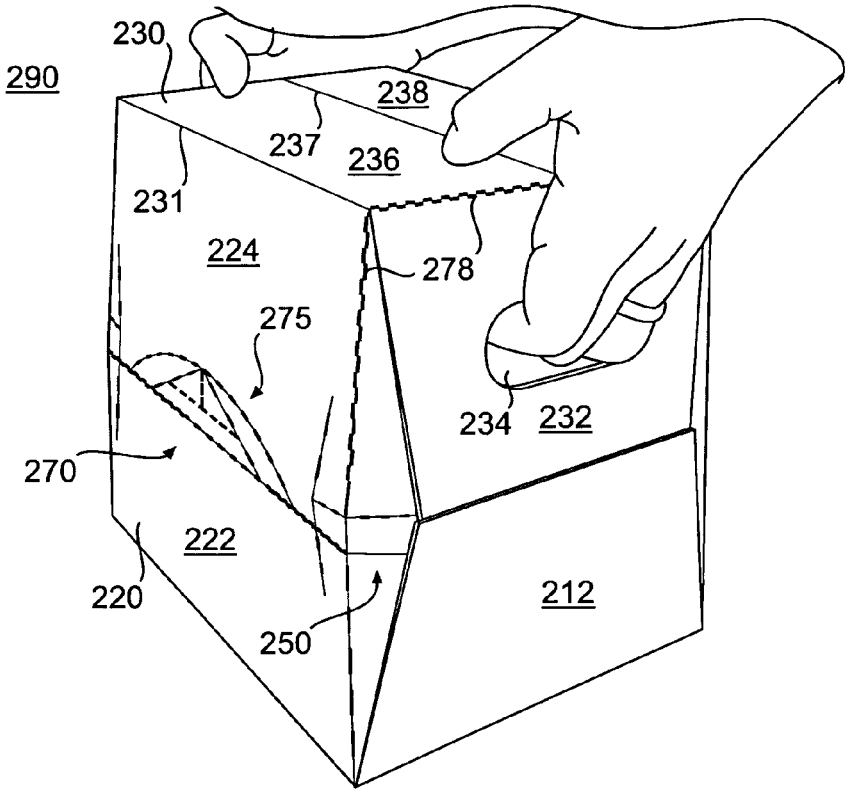
FIG. 17 illustrates use of a handle carrying feature of the third carton embodiment.

The exemplary methods for erecting cartons discussed above can also be employed to erect the carton 290. FIGS. 15 and 16 illustrate opposite sides of the fully erected carton 290. In this embodiment, the containers C (not visible in FIGS. 15 and 16) are arranged in a 3×4 orientation, although other configurations can be used. Referring to FIG. 15, the transverse fold line 276 extends through the second side panel 240 and the longitudinal fold lines 274, 278 are adjacent to end panels 292, 294, respectively. Referring to FIG. 16, the opening flap 275 extends across a significant portion of the length of the first side panel 220 to allow for easy opening of the dispenser section 271. One of the handle apertures 234 is located in the second end panel 294; the corresponding handle aperture 234 (not visible in FIGS. 15-16) is located in the first end panel 292. FIG. 17 illustrates use of the handle apertures 234 to carry the carton 290.

Figure 18:
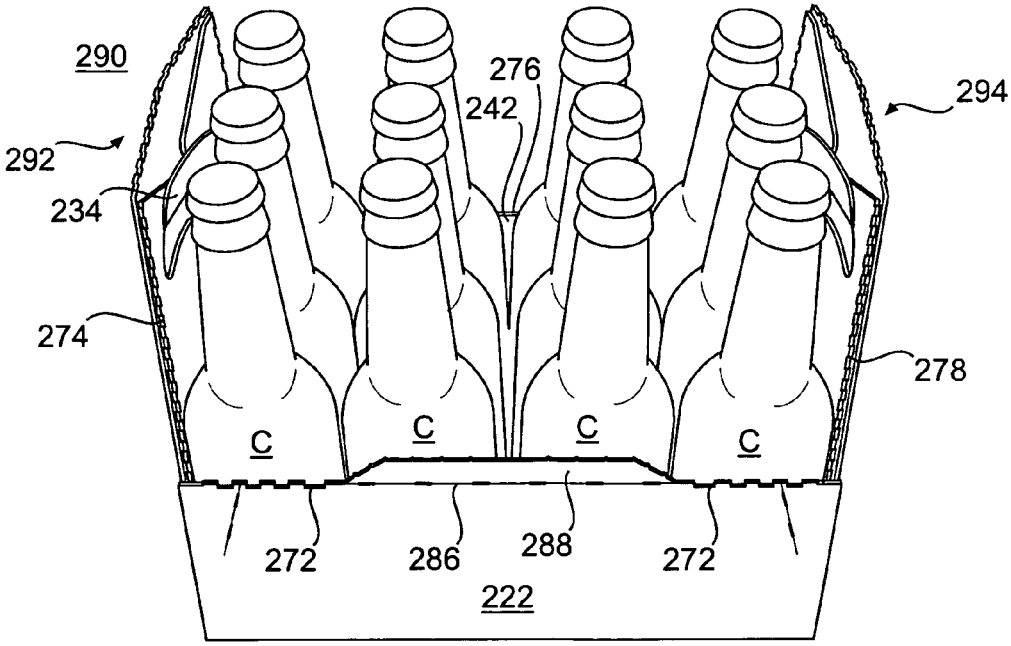
FIG. 18 illustrates the third carton embodiment after opening of the carton.

Referring to FIGS. 16 and 18, a user typically opens the dispenser section 271 along the dispenser pattern 270. The user initiates opening of the dispenser section 271 by breaching the opening flap 275 and pulling the dispenser section 271 away from the remainder of the carton 290. The dispenser section 271 can remain hingedly attached to the carton 290 or be completely removed from the carton 290 as shown in FIG. 18.

FIG. 18 illustrates the opened carton 290 with the dispenser section 271 removed. The opened carton 290 allows access to and visibility of the containers C from both sides and from the top of the carton 290. The end panels 292, 294 remain to allow for easy carrying of the opened carton 290 by the handles 234 disposed in the end panels. The carton 290 can be stored inside a refrigerator, and provides easy access to, for example, glass or plastic beverage bottles.

Figure 19:
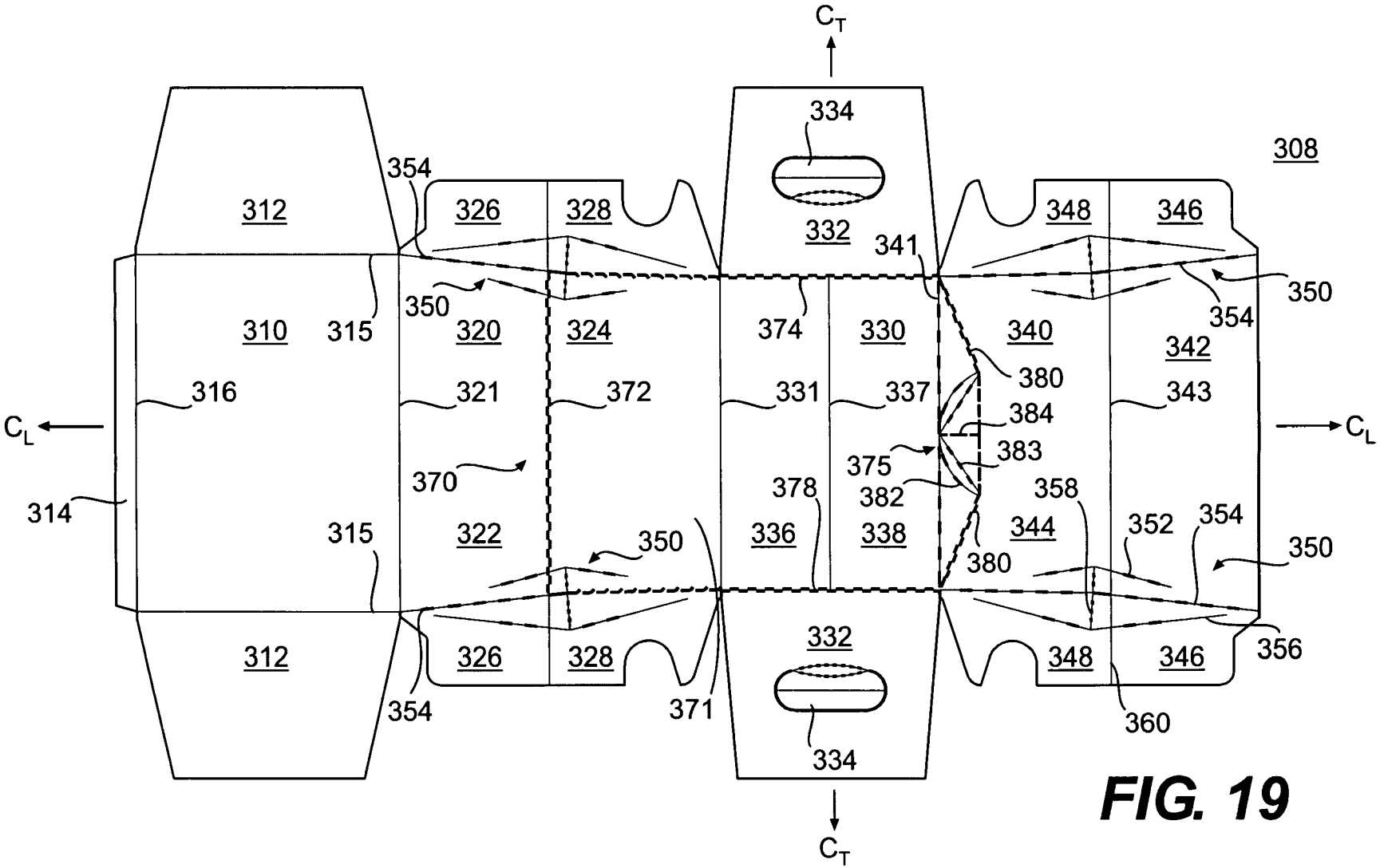
FIG. 19 is a plan view of a blank from which a carton having a dispenser section according to a fourth embodiment of the invention is formed.
Figure 20:
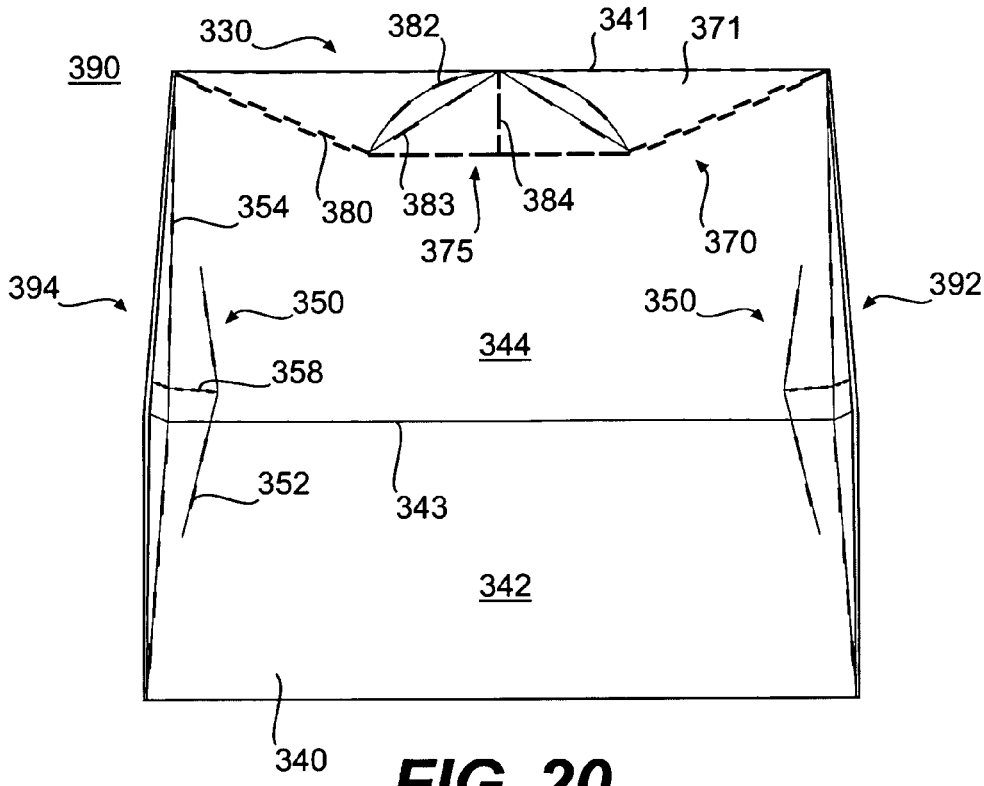
FIG. 20 illustrates one side of the fourth carton embodiment.
Figure 21:
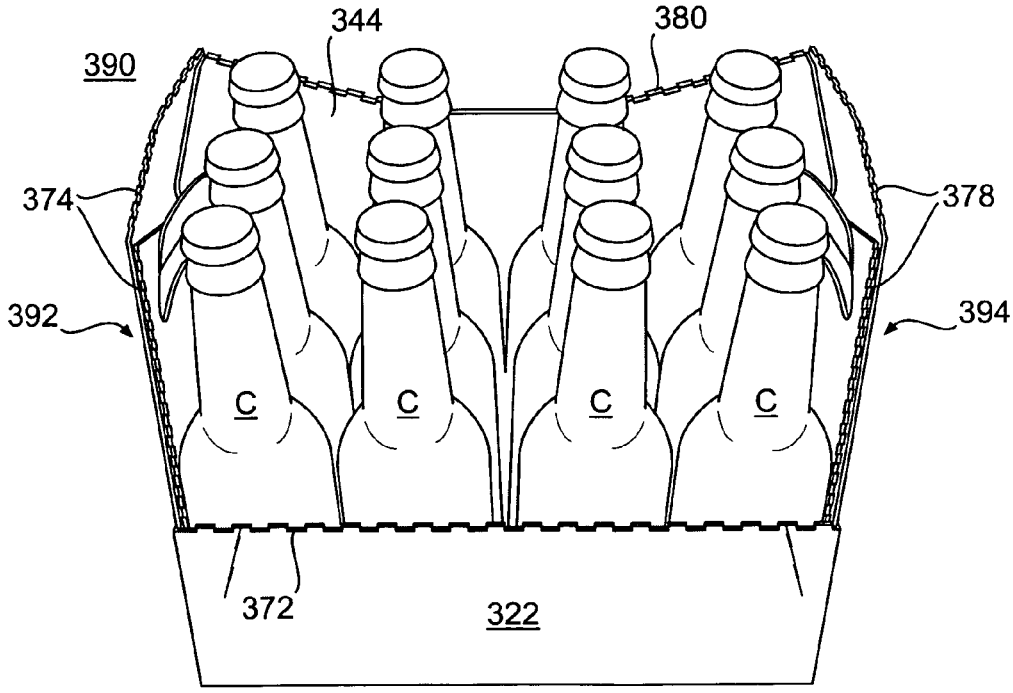
FIG. 21 illustrates the fourth carton embodiment after opening.

According to a fourth embodiment of the invention, illustrated by FIGS. 19-21, a dispenser opening is created in a carton 390 by removing or at least partially separating a section of a second side panel 340, a top panel 330, and an upper portion of a first side panel 320 of the carton 390. The section of the second side panel 340 that remains with the carton 390 provides additional stability to the carton. When opened, the carton 390 provides easy access to articles from top and the open side of the carton.

FIG. 19 is a plan view of a blank 308 used to form the carton 390 (FIG. 20) according to the fourth embodiment of the invention. As shown in FIG. 19, the blank 308 comprises a glue flap 314 foldably connected to a rectangular bottom panel 310 at a first transverse fold line 316. The bottom panel 310 is foldably connected to the first side panel 320 at a second transverse fold line 321, the top panel 330 is foldably connected to the first side panel 320 at a third transverse fold line 331, and the second side panel 340 is foldably connected to the top panel 330 at a fourth transverse fold line 341. Oppositely disposed bottom end flaps 312 are foldably connected to the bottom panel 310 at longitudinal fold lines 315. Oppositely disposed top end flaps 332 are foldably connected to the top panel 330 at longitudinal fold lines 374, 378. Handle apertures 334 can be included in the top end flaps 332. The top panel 330 also can comprise a first side top panel 336 and a second side top panel 338 foldably connected at a transverse fold line 337.

The first side panel 320 can comprise a first upper side panel 324 and a first lower side panel 322 foldably connected at a transverse fold line 372. Oppositely disposed end flaps 328 are foldably connected to the first upper side panel 324 at the longitudinal fold lines 374, 378. Similarly, oppositely disposed end flaps 326 are foldably connected to the first lower side panel 322 at oblique fold lines 354. The second side panel 340 can comprise a second upper side panel 344 and a second lower side panel 342 foldably connected at a transverse fold line 343. Oppositely disposed end flaps 348 are foldably connected to the second upper side panel 344 at the oblique fold lines 354. Similarly, oppositely disposed end flaps 346 are foldably connected to the second lower side panel 342 at the oblique fold lines 354. The longitudinal fold lines 315, 374, 378 and the oblique fold lines 354 may be straight fold lines, or may be offset at one or more locations to account for, for example, blank thickness.

The blank 308 includes four diamond corners 350. Two are formed in the first upper side panel 324, the first lower side panel 322, and the end flaps 326, 328; these two diamond corners 350 are located at opposite ends of the first side panel 320. Similarly, two diamond corners 350 are formed in the second upper side panel 344, the second lower side panel 342, and the end flaps 346, 348; these two diamond corners 350 are located at opposite ends of the second side panel 340. At each of these locations, the diamond corners 350 are defined in part by transverse fold lines 358, 360, V-shaped fold lines 352, 356, and the oblique fold line 354.

According to one aspect of the present embodiment, a dispenser pattern 370 formed in the blank 308 defines a dispenser section 371. The dispenser pattern 370 can be generally similar in shape, construction and function to the dispenser pattern 170 illustrated in FIG. 9, and generally comprises a pattern of lines of disruption in the blank 308 that allow the dispenser section 371 to remain hingedly attached to or to be completely removed from the carton 390 (illustrated in FIG. 20). An opening section or flap 375 in the section 371 is defined by oblique opening lines 380, a curved opening line 382, a V-shaped opening line 383, and a T-shaped opening line 384.

The exemplary methods discussed above for erecting cartons can also be employed to erect the carton 390. FIG. 20 illustrates the fully erected carton 390 filled with containers C (not visible) in a 3×4 orientation. The erected carton 390 has a first end panel 392 and a second end panel 394 formed from the end flaps illustrated in FIG. 19. The opening flap 375 is located at the top of the second upper side panel 344, and extends across a substantial portion of the width of the side panel 340 to allow for easy opening of the dispenser section 371. A user can breach one or more of the lines 382, 383, 384 of the opening flap 375 in order to grasp the dispenser section 371. The dispenser section 371 may then be torn along the dispenser pattern 370 and removed from the carton 390.

FIG. 21 illustrates the opened carton 390. The carton 390 is open on one side above the first lower side panel 322. At the other side of the carton 390, the second upper side panel 344 may remain intact up to the oblique opening line 380. After opening, the carton 390 allows both visibility and easy access to the containers C from the open side and from the top of the carton 390. The section of the second side panel 340 that remains with the carton 390 provides additional stability to the carton 390.

The lengths of the opening flaps in the cartons 90, 190, 290, 390 illustrated in FIGS. 1-21, as measured along the side panels, can be selected to provide ease of opening of the dispenser sections. In the cartons 190, 390 shown in FIGS. 11 and 20, respectively, the opening flaps span essentially the entire lengths of the cartons 190, 390. The exemplary opening flaps 75, 275 illustrated in FIGS. 6 and 16, respectively, span about ½ to about ¾ of the length of the cartons 90, 290. In general, the ratio of the length of an opening flap to the overall length of its carton can range from about 0.4 to 1. In another aspect of the present invention, the ratio of the length of the opening flap to the length of the carton can range from about 0.6 to 1. In yet another aspect of the present invention, the ratio of the length of the opening flap to the length of the carton can range from about 0.8 to 1.

According to a fifth embodiment of the invention, illustrated by FIGS. 22-27, a dispenser opening is created in a carton 490 by removing or at least partially separating a section of both a first side panel 420 and a second side panel 440, and portions of both one end panel 492 and a top panel 430 of the carton 490. The dispenser section can remain hingedly attached to the carton 490 or be completely removed from the carton. A portion of the first end panel 492 and a second end panel 494 of the carton 490 may remain substantially intact to allow easy carrying of the opened carton by handle apertures 418 disposed in the end panels. When opened, the carton 490 provides easy access to articles from the top, both sides, and one end of the carton.

Figure 22:
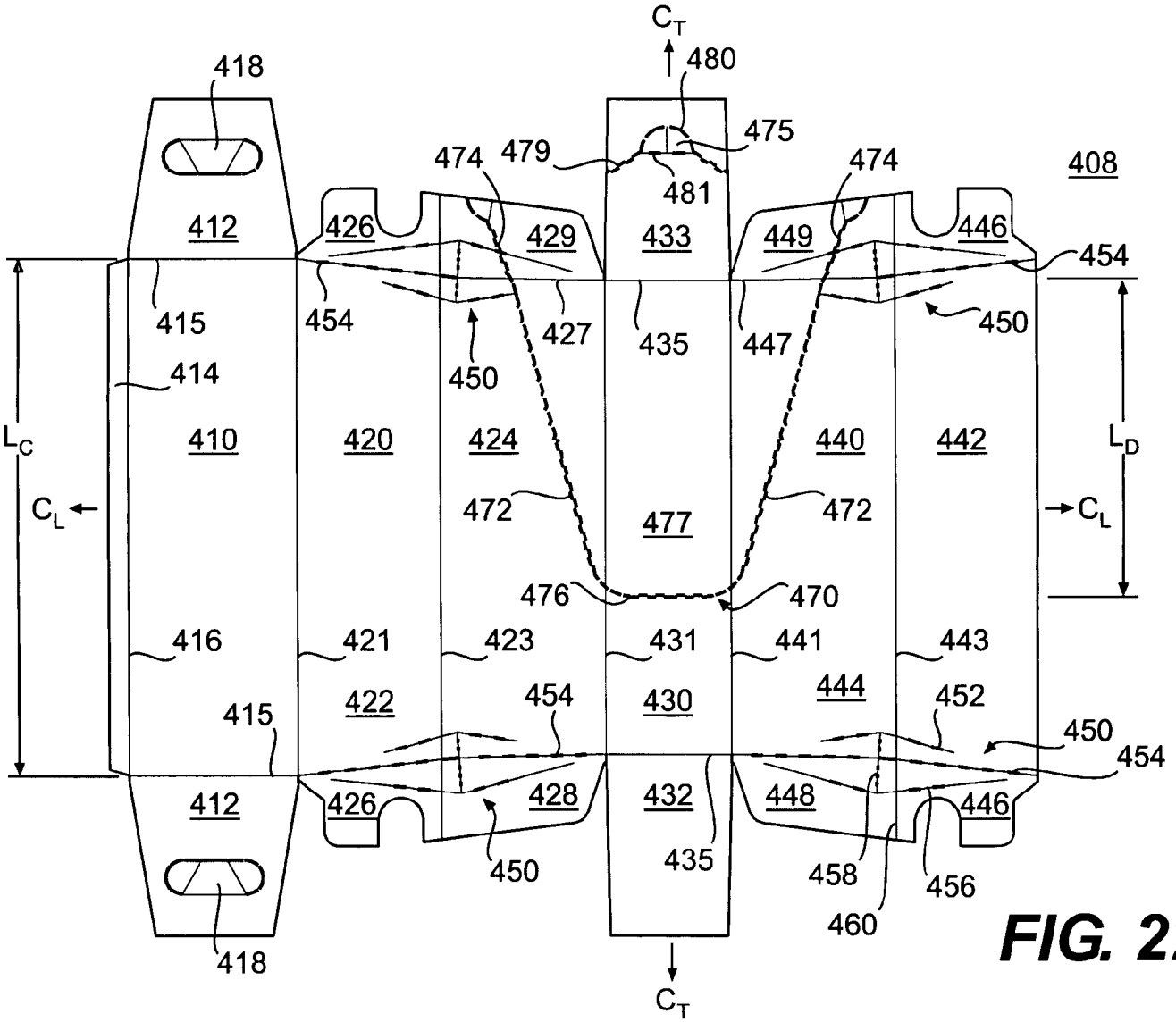
FIG. 22 is a plan view of a blank from which a carton having a dispenser section according to a fifth embodiment of the invention is formed.
Figure 23:
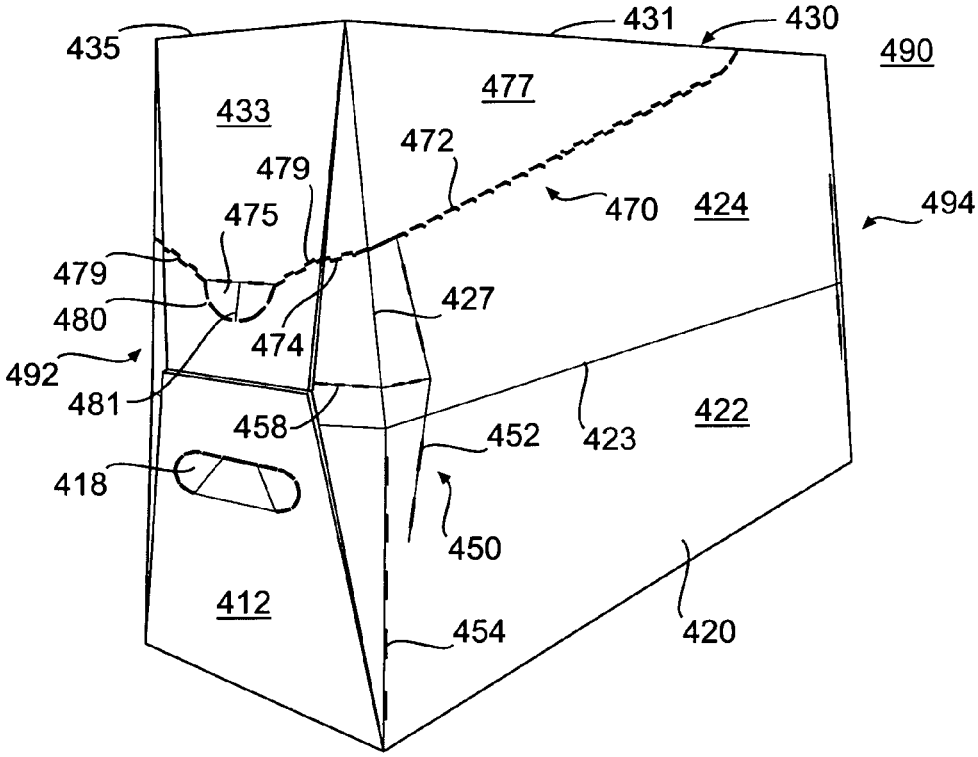
FIG. 23 is a perspective view of the fifth carton embodiment.

FIG. 22 is a plan view of a blank 408 used to form the carton 490 (illustrated in FIG. 23). The blank 408 can be symmetric or partially symmetric about a longitudinal centerline $C_L$ and about a transverse centerline $C_T$. Therefore, certain elements in the drawing figures have similar or identical reference numerals in order to reflect the whole or partial longitudinal and transverse symmetries. As shown in FIG. 22, the blank 408 comprises a glue flap 414 which is foldably connected to a rectangular bottom panel 410 at a first transverse fold line 416. The bottom panel 410 is foldably connected to the first side panel 420 at a second transverse fold line 421, the top panel 430 is foldably connected to the first side panel 420 at a third transverse fold line 431, and the second side panel 440 is foldably connected to the top panel 430 at a fourth transverse fold line 441. Oppositely disposed bottom end flaps 412 are foldably connected to the bottom panel 410 at longitudinal fold lines 415. Oppositely disposed top end flaps 432, 433 are foldably connected to the top panel 430 at longitudinal fold lines 435. The handle apertures 418 can be included in the bottom end flaps 412.

The first side panel 420 can comprise a first upper side panel 424 and a first lower side panel 422 foldably connected at a transverse fold line 423. Oppositely disposed end flaps 428 and 429 are foldably connected to the first upper side panel 424 at fold lines 454 and 427, respectively. Similarly, oppositely disposed end flaps 426 are foldably connected to the first lower side panel 422 at the oblique fold lines 454. The second side panel 440 can comprise a second upper side panel 444 and a second lower side panel 442 foldably connected at a transverse fold line 443. Oppositely disposed end flaps 448 and 449 are foldably connected to the second upper side panel 444 at fold lines 454 and 447, respectively. Similarly, oppositely disposed end flaps 446 are foldably connected to the second lower side panel 442 at the oblique fold lines 454. The longitudinal fold lines 415, 435 and the fold lines 454, 447, 427 may be straight fold lines, or may be offset at one or more locations to account for, for example, blank thickness.

The blank 408 includes four diamond corners 450. Two are formed in the first upper side panel 424, the first lower side panel 422, and the end flaps 426, 428, 429; these two diamond corners 450 are located at opposite ends of the first side panel 420. Similarly, two diamond corners 450 are formed in the second upper side panel 444, the second lower side panel 442, and the end flaps 446, 448, 449; these two diamond corners 450 are located at opposite ends of the second side panel 440. At each of these locations, the diamond corners 450 are defined in part by transverse fold lines 458, 460, V-shaped fold lines 452, 456, and the oblique fold line 454.

According to one aspect of the present embodiment, a dispenser pattern 470 formed in the blank 408 defines a dispenser section 477. The dispenser pattern 470 can generally comprise a pattern of lines of disruption in the blank 408 that allow the dispenser section 477 to remain hingedly attached or be completely removed from the carton 490 (illustrated in FIG. 23). The dispenser pattern 470 comprises tear lines 472, 474, 476, 479, 480 and a crease line 481 and further defines an opening section or flap 475 within the dispenser section 477. The oblique tear lines 472 are located in the first upper side panel 424 and the second upper side panel 444. The longitudinal tear line 476 is positioned in the top panel 430 and connects the oblique tear lines 472. The tear lines 474 are located in the end flaps 429, 449 and conform generally to the semi-circular line 480 and the oblique tear lines 479 when the end panels are formed. The opening flap 475 is located in the top end flap 433 and comprises the semi-circular opening tear line 480, the oblique opening tear lines 479, and the T-shaped opening crease line 481.

For a carton with a length $L_C$, the length of the dispenser section $L_D$, or, in other words, the distance that the dispenser section 477 extends into the top panel 430, may be measured by the distance between the longitudinal tear line 476 and the longitudinal fold line 435.

Figure 24:
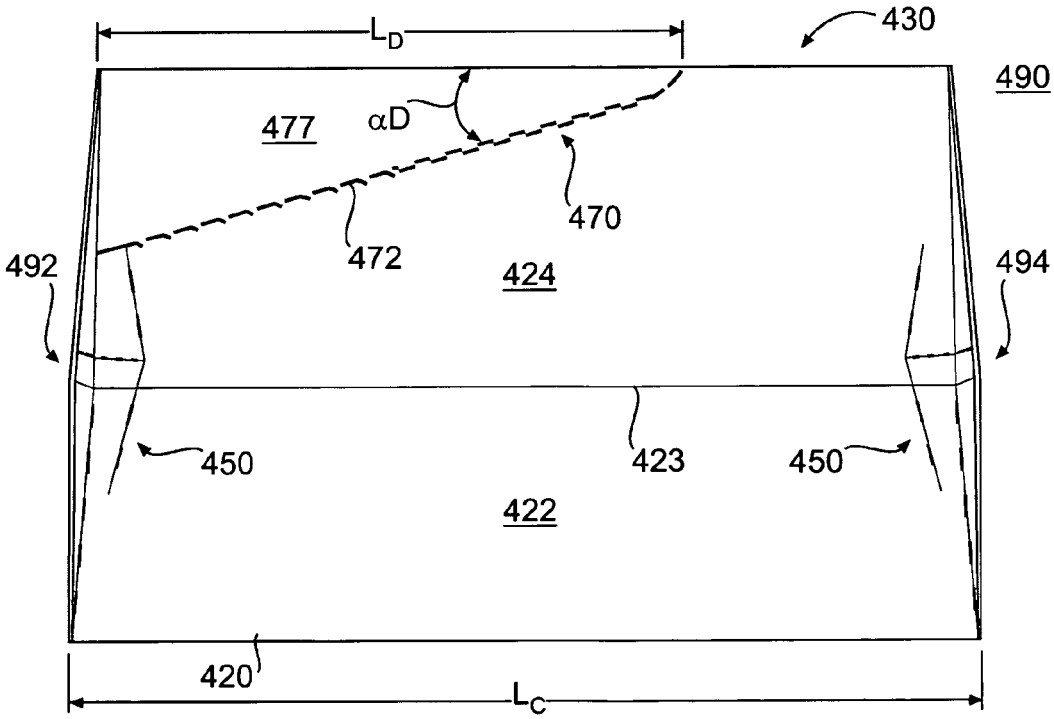
FIG. 24 illustrates one side of the fifth carton embodiment.

FIG. 23 is a perspective view of one side of the carton 490 erected from the blank 408, and FIG. 24 is a side view of the same side of the erected carton 490. The exemplary carton 490 is filled with containers C (not visible in FIGS. 23 and 24) in a 2×6 orientation. The first end panel 492 and the second end panel 494 are formed at opposite ends of the carton 490 by adhering the end flaps (illustrated in FIG. 22) together. The dispenser section 477 extends across the top panel 430, the side panels 420, 440, and the end panel 492. The opening flap 475, the tear lines 474, the curved tear line 480, the crease line 481, and the oblique tear lines 479 are located in the first end panel 492. The oblique tear line 472 is located in the first upper side panel 424; a similar oblique tear line 472 is located in the second upper side panel 444 (illustrated in FIG. 22).

FIG. 24 illustrates the relationship of the length $L_D$ of the dispenser section 477 to the length $L_C$ of the carton 490, and a dispenser section angle $\alpha D$ defined by the oblique lines 472 measured with respect to the plane of the top panel 430. According to one aspect of the embodiment, the ratio of the length of the dispenser section $L_D$ to the length of the carton $L_C$, and the dispenser section angle $\alpha D$, may be selected to provide access to a selected number of containers C within the carton 490 (illustrated in FIG. 27). In the exemplary embodiment illustrated in FIGS. 22-27, the ratio of the length of the dispenser section $L_D$ to the length of the carton $L_C$ is in the range of about 0.6 to about 0.7 and the dispenser section angle $\alpha D$ is in the range of about 15° to about 20°.

Figure 25:
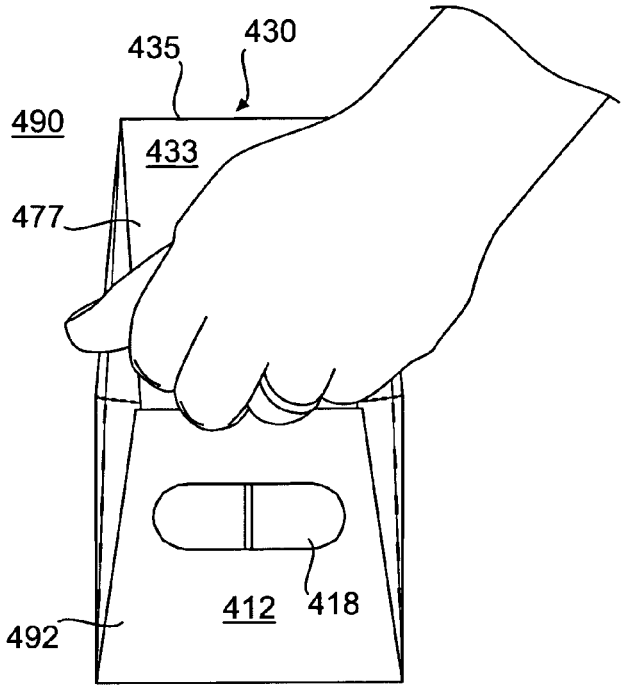
FIG. 25 illustrates opening of the fifth carton embodiment.
Figure 26:
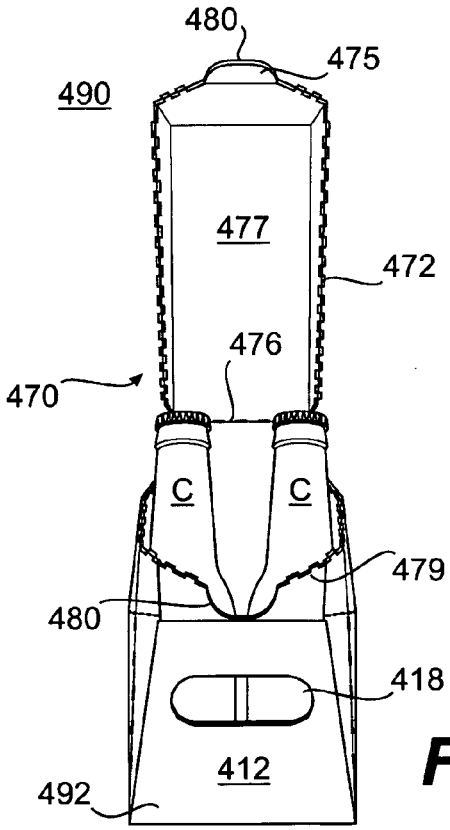
FIG. 26 is an end view of the fifth carton embodiment after opening and with the dispenser section hingedly attached.
Figure 27:
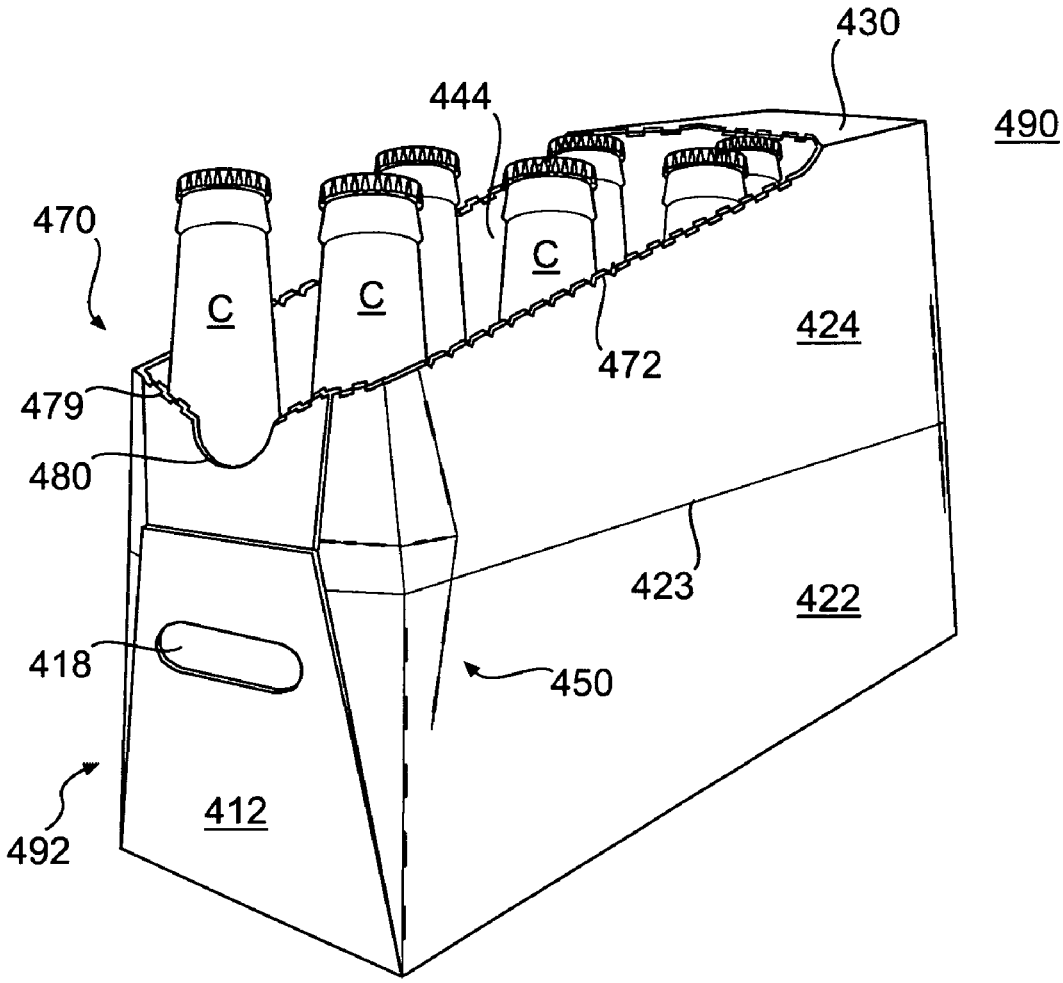
FIG. 27 is a perspective view of the fifth carton embodiment after opening.

FIGS. 25-27 illustrate an exemplary method of opening of the carton 490. Referring to FIG. 25, a user can breach the opening flap 475 (illustrated in FIG. 23) along the semi-circular line 480 and depressing the flap 475 at the opening crease line 481 in order to grasp the dispenser section 477. After the opening flap 475 has been breached, the dispenser section 477 may be pulled vertically along the tear lines 474, 479 (illustrated in FIG. 23) in the first end panel 492. Then, as shown in FIG. 26, the carton 490 continues to open along the dispenser pattern 470 as the dispenser section 477 is pulled vertically along the oblique tear lines 472 in the first upper side panel 424 and the second upper side panel 444. Once the longitudinal tear line 476 is reached, the dispenser section 477 can remain hingedly attached to the carton 490, as shown in FIG. 26. In this configuration, the dispenser section 477 can be tilted open to remove the containers C from the carton 490 and then tilted back into its original closed orientation to cover the containers C so that they are no longer visible. Alternatively, the dispenser section 477 may be completely separated from the remainder of the carton 490.

FIG. 27 illustrates the opened carton 490 with the dispenser section 477 removed. The opened carton 490 allows access to and visibility of the containers C from the top, both sides, and one end of the carton 490. The carton 490 can be easily carried by the handles 418 in the end panels 492, 494. Even after opening the carton 490, the carton has high side panels which provide for high strength and rigidity. The carton 490 can be stored, for example, inside a refrigerator, and provides easy access to, for example, glass or plastic beverage bottles. The 2×6 configuration generally will allow the carton 490 to be placed and stored in a door shelf of a refrigerator, if desired. Optionally, the carton 490 can be placed on another shelf in the refrigerator or on another surface, where the carton provides easy access to articles from the top, both sides, and one end of the carton.

Figure 28:
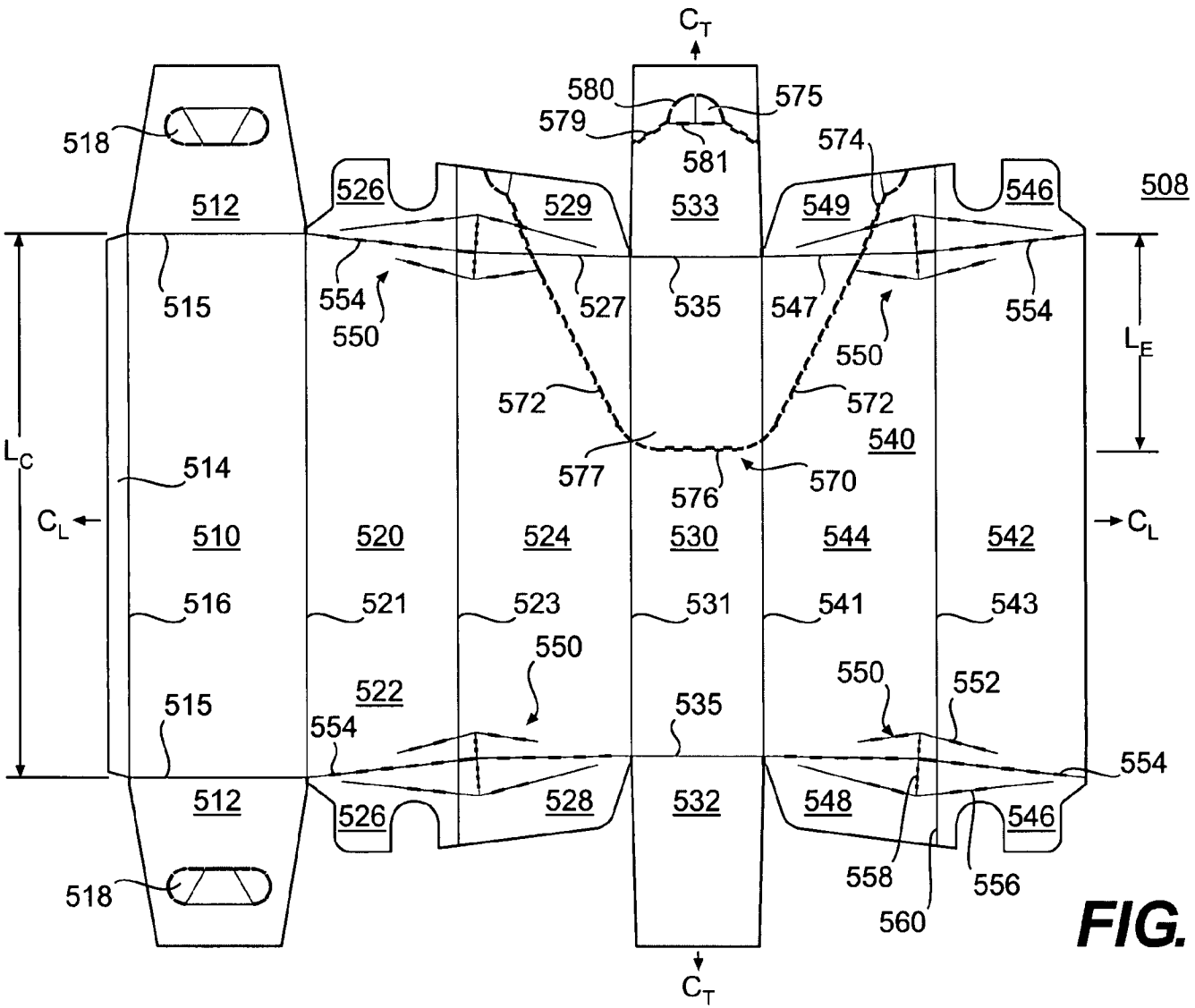
FIG. 28 is a plan view of a blank from which a carton having a dispenser section according to a sixth embodiment of the invention is formed.
Figure 29:
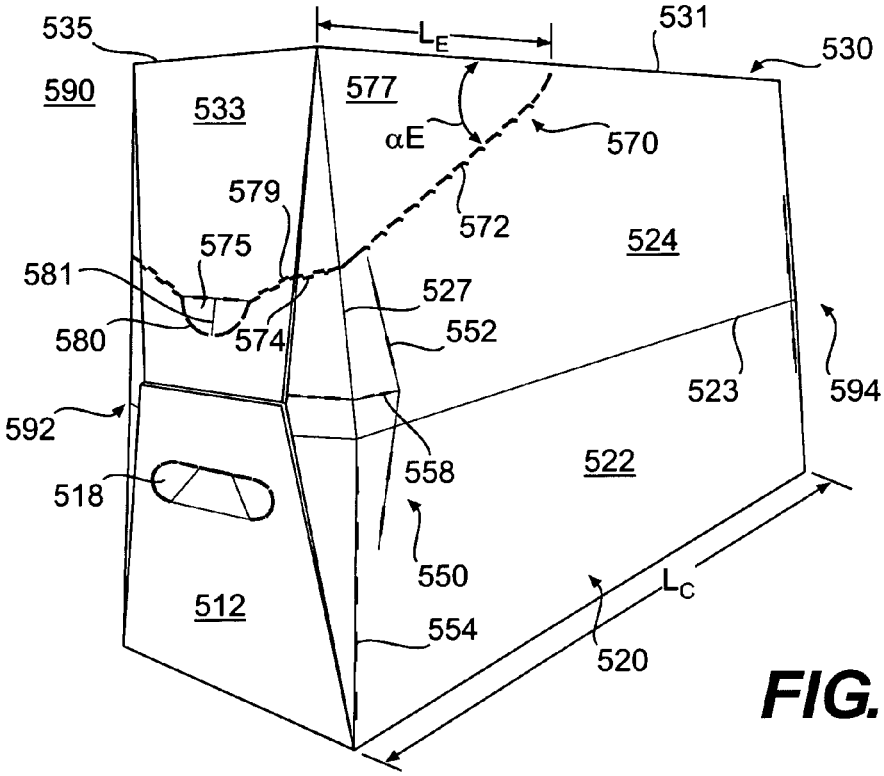
FIG. 29 is a perspective view showing one side of the sixth carton embodiment.
Figure 30:
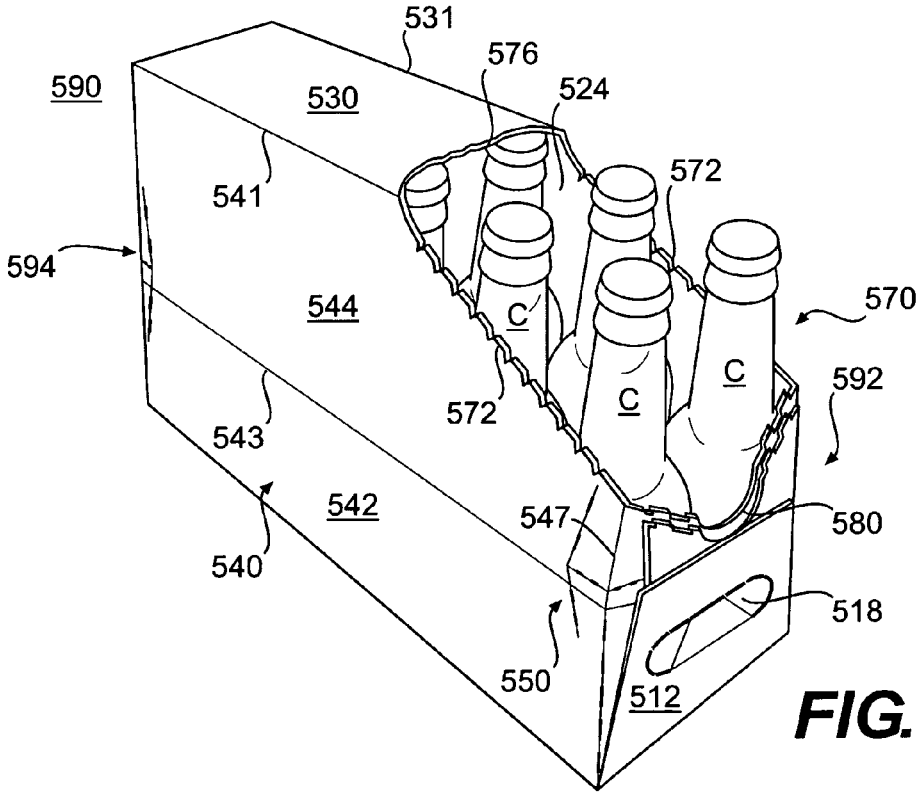
FIG. 30 is a perspective view of the sixth carton embodiment after opening.

According to a sixth embodiment of the invention, illustrated by FIGS. 28-30, a dispenser opening is created in a carton 590 by removing or at least partially separating a section of both a first side panel 520 and a second side panel 540, and portions of both one end panel 592 and a top panel 530 of the carton 590. When opened, the carton 590 provides easy access to articles from the top, both sides, and one end of the carton.

FIG. 28 is a plan view of a blank 508 used to form the carton 590 (illustrated in FIG. 29). As shown in FIG. 28, the blank 508 comprises a glue flap 514 foldably attached to a rectangular bottom panel 510 at a first transverse fold line 516. The bottom panel 510 is foldably connected to the first side panel 520 at a second transverse fold line 521, the top panel 530 is foldably connected to the first side panel 520 at a third transverse fold line 531, and the second side panel 540 is foldably connected to the top panel 530 at a fourth transverse fold line 541. Oppositely disposed bottom end flaps 512 are foldably connected to the bottom panel 510 at longitudinal fold lines 515. Oppositely disposed top end flaps 532, 533 are foldably connected to the top panel 530 at longitudinal fold lines 535. Handle apertures 518 can be included in the bottom end flaps 512.

The first side panel 520 can comprise a first upper side panel 524 and a first lower side panel 522 foldably connected at a transverse fold line 523. Oppositely disposed end flaps 528 and 529 are foldably connected to the first upper side panel 524 at oblique fold lines 554 and 527, respectively. Similarly, oppositely disposed end flaps 526 are foldably connected to the first lower side panel 522 at the oblique fold lines 554. The second side panel 540 can comprise a second upper side panel 544 and a second lower side panel 542 foldably connected at a transverse fold line 543. Oppositely disposed end flaps 548 and 549 are foldably connected to the second upper side panel 544 at the oblique fold lines 554 and 547, respectively. Similarly, oppositely disposed end flaps 546 are foldably connected to the second lower side panel 542 at the oblique fold lines 554. The longitudinal fold lines 515, 535 and the oblique fold lines 554, 527, 547 may be straight fold lines, or may be offset at one or more locations to account for, for example, blank thickness.

The blank 508 includes four diamond corners 550. Two are formed in the first upper side panel 524, the first lower side panel 522, and the end flaps 526, 528, 529; these two diamond corners 550 are located at opposite ends of the first side panel 520. Similarly, two diamond corners 550 are formed in the second upper side panel 544, the second lower side panel 542, and the end flaps 546, 548, 549; these two diamond corners 550 are located at opposite ends of the second side panel 540. At each of these locations, the diamond corners 550 are defined in part by transverse fold lines 558, 560, V-shaped fold lines 552, 556, and the oblique fold line 554.

According to one aspect of the present embodiment, a dispenser pattern 570 formed in the blank 508 defines a dispenser section 577. The dispenser pattern 570 can be generally similar in shape, construction and operation to the dispenser pattern 470 illustrated in FIG. 22, and comprises tear lines 572, 574, 576, 579, 580 and a crease line 581. The dispenser pattern 570 further defines an opening section or flap 575 within the dispenser section 577. For a carton with a length $L_C$, the length of the dispenser section $L_E$ may be determined by the distance between the longitudinal tear line 576 and the longitudinal fold line 535.

The exemplary methods discussed above for erecting cartons can be used to erect the carton 590. FIG. 29 illustrates the erected carton 590 filled with containers C (not visible in FIG. 29) in a 2×6 orientation. The ends of the carton 590 are closed by a first end panel 592 and a second end panel 594. The dispenser section 577 extends across the top panel 530, the side panels 520, 540, and the end panel 592. The opening flap 575, the tear lines 574, the semi-circular tear line 580, the crease line 581 and the oblique tear lines 579 are located in the first end panel 592. The oblique tear line 572 is located in the first upper side panel 524; a similar oblique tear line 572 is located in the second upper side panel 544 (illustrated in FIG. 28).

FIG. 29 illustrates the relationship of the length of the dispenser section $L_E$ to the length $L_C$ of the carton 590, and a dispenser section angle $\alpha E$ between the oblique tear lines 572 and the plane of the top panel 530. According to one aspect of the present embodiment, the ratio of the length of the dispenser section $L_E$ to the length of the carton $L_C$, and the dispenser section angle $\alpha E$, may be selected to provide access to selected containers C within the carton 590 (shown in FIG. 30). In the exemplary embodiment illustrated in FIGS. 27-30, the ratio of the length of the dispenser section $L_E$ to the length of the carton $L_C$ is in the range of about 0.3 to about 0.4. The dispenser section angle $\alpha E$ is in the range of about 25° to about 30°.

FIGS. 29 and 30 illustrate an exemplary method of opening of the carton 590. Referring to FIG. 29, a user can breach the opening flap 575 along the semi-circular tear line 580 and/or the crease line 581 in order to grasp the dispenser section 577. After the opening flap 575 has been breached, the dispenser section 577 may be separated from the remainder of the carton 590 along the dispenser pattern 570. Once the longitudinal line 576 is reached, the dispenser section 577 can remain hingedly attached to the carton 590. Alternatively, the dispenser section 577 may be pulled horizontally, completely removing the dispenser section 577 from the remainder of the carton 590.

FIG. 30 illustrates the opened carton and dispensing feature with the dispenser section 577 removed. The opened carton 590 allows access to and visibility of the containers C from the top, both sides, and one end of the carton 590. The carton 590 can be easily carried by the handle apertures 518 in the end panels 592, 594 of the carton 590. The carton 590 has high side panels that provide for high strength and rigidity even after the carton 590 is opened.

The lengths $L_D$ and $L_E$ of the dispenser sections 477 and 577, respectively, illustrated in FIGS. 24 and 29 can be varied to provide different dispensing properties to the cartons 490, 590. At the upper limit, the dispenser lengths $L_D$ and $L_E$ can be substantially equal to the length of the carton $L_C$; in this instance, the dispensing sections span the entire length of the carton. In one aspect of the present invention, the ratio of the length of a dispenser section to the length of a carton can range from about 0.2 to 0.9. In another aspect, the ratio of the length of a dispenser section to the length of a carton can range from about 0.3 to 0.7. The dispenser section angles $\alpha D$ and $\alpha E$ illustrated in FIGS. 24 and 29 can range from about 10° to about 70°. In another aspect of the present invention, the dispenser section angle can range from about 15° to about 55°. In yet another aspect, the dispenser section angle can range from about 15° to about 45°.

In the above embodiments, the cartons are shown as accommodating "long-necked" glass beverage bottles. Other types of articles, however, can be accommodated within cartons according to the present invention. These articles can include beverage containers such as plastics bottles, metal cans, as well as other containers that can be generally cylindrical in shape, such as those used in packaging foodstuffs. The dimensions of the blanks and corresponding cartons formed from the blanks may also be altered, for example, to accommodate various container forms, shapes, sizes, or quantities.

For purposes of illustrating the various embodiments of the present invention, the cartons illustrated above are sized and dimensioned to contain 12 articles or containers in a 2×6 or 3×4 configuration. The present invention is not limited to any specific size, dimension, or geometry of carton. For example, the present invention would work satisfactorily if sized and shaped to hold articles of other configurations, such as 4×3, 2×4, 2×5, 4×6, 4×5, 3×6, 5×6, 6×2, etc.

The cartons of the exemplary embodiments include four diamond corners. The term "diamond corner" as used in this specification does not necessarily indicate a perfect geometric "diamond" shape. To the contrary, the diamond corners disclosed in this specification have a general diamond shape as generally known in the art.

In the exemplary embodiments discussed above, the blanks can be formed from clay-coated newsprint (CCN). In general, the blanks can be constructed of paperboard, having a caliper of at least about 14 points, so that it is heavier and more rigid than ordinary paper. For example, caliper of the blank can be in the range of about 16 to about 22 point. The blanks, and thus the cartons, can also be constructed of other materials, such as cardboard, or any other material having properties suitable for enabling the carton to function at least generally as described above. The first and second sides of the blanks can be coated with, for example, a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks. The blanks can also be laminated to or coated with one or more sheet-like materials at selected panels, panel sections, or the entire blank. Non-limiting examples of sheet-like materials can include decorative films, protective films, barrier films, or other types of plastic films of compositions appropriate for their intended use.

In accordance with the exemplary embodiments, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

A tear line can be any substantially linear, although not necessarily straight, form of weakening that facilitates tearing therealong. Specifically, but not for the purpose of narrowing the scope of the present invention, tear lines include: a cut that extends partially into the material along the desired line of weakness, and/or a series of cuts that extend partially into and/or completely through the material along the desired line of weakness, or various combinations of these features. As a more specific example, one type of tear line is in the form of a series of cuts that extend completely through the material, with adjacent cuts being spaced apart slightly so that small somewhat bridge-like pieces of the material (e.g., 'nicks') are defined between adjacent cuts. The nicks are broken during tearing along the tear line. Such a tear line that includes nicks can also be referred to as a cut line, since the nicks typically are a relatively small in relation to the cuts.

The term "line" as used herein includes not only straight lines, but also other types of lines such as curved, curvilinear or angularly displaced lines, and combinations of adjacent line segments.

The above embodiments may be described as having one or panels adhered together by glue. The term "glue" is intended to encompass all manner of adhesives commonly used to secure paperboard carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A carton and a plurality of articles contained therein, the carton comprising:

a bottom panel;

a first side panel comprising a first lower side panel and a first upper side panel, the first upper side panel being foldably connected to the first lower side panel at a first fold line extending across the first side panel;

a second side panel comprising a second lower side panel and a second upper side panel, the second upper side panel being foldably connected to the second lower side panel at a second fold line extending across the second side panel;

a top panel;

a plurality of first end flaps at a first end of the carton and forming a first end panel, the plurality of first end flaps comprising a first side end flap comprising at least a first upper side end flap foldably connected to the first upper side panel, a second side end flap comprising at least a second upper side end flap foldably connected to the second upper side panel, a top end flap foldably connected to the top panel, and a bottom end flap foldably connected to the bottom panel;

a plurality of second end flaps at a second end of the carton and forming a second end panel, the plurality of second end flaps comprising a first side end flap comprising at least a first upper side end flap foldably connected to the first upper side panel, a second side end flap comprising at least a second upper side end flap foldably connected to the second upper side panel, a top end flap foldably connected to the top panel, and a bottom end flap foldably connected to the bottom panel;

a first handle formed in the first end panel comprising a first handle opening in at least one of the plurality of first end flaps; and a second handle formed in the second end panel comprising a second handle opening in at least one of the plurality of second end flaps, wherein a dispenser pattern defines a dispenser section at least in the first upper side panel and the second upper side panel, wherein the dispenser section comprises all of the top panel, wherein the dispenser pattern comprises a first transverse tear line extending along and collinear with the first fold line and a second transverse tear line extending along and collinear with the second fold line, each of the first and second transverse tear lines at least partially defining an edge of the dispenser section, and each of the first and second transverse tear lines extending across the respective first and second side panels from the first end panel to the second end panel;

wherein the dispenser pattern further comprises a first longitudinal tear line and a second longitudinal tear line, the first and second longitudinal tear lines extending from a respective end of the first transverse tear line to a respective end of the second transverse tear line, wherein the first upper side end flap, the top end flap, and the second upper side end flap of the plurality of first end flaps are foldably connected to the respective first upper side panel, top panel, and second upper side panel along the first longitudinal tear line, and wherein the first upper side end flap, the top end flap, and the second upper side end flap of the plurality of second end flaps are foldably connected to the respective first upper side panel, top panel, and second upper side panel along the second longitudinal tear line.

2. The carton of claim 1, wherein the dispenser pattern comprises a plurality of opening lines defining an opening section in the first upper side panel.

3. The carton of claim 2, wherein the opening section abuts the first fold line.

4. The carton of claim 1, wherein the dispenser pattern comprises a plurality of opening lines defining an opening section in the second upper side panel.

5. The carton of claim 4, wherein the opening section is adjacent to the top panel.

6. The carton of claim 4, wherein the dispenser pattern comprises a first longitudinal tear line extending along a first upper edge of the carton and a second longitudinal tear line extending along a second upper edge of the carton.

7. The carton of claim 4, wherein the first end panel is connected to the first side panel at a first diamond corner and connected to the second side panel at a second diamond corner.

8. The carton of claim 1, wherein the dispenser section is further defined in the first end panel.

9. The carton of claim 8, wherein the dispenser pattern comprises a first oblique tear line extending through the first side panel and a second oblique tear line extending through the second side panel.

10. The carton of claim 9, wherein the dispenser pattern comprises a top tear line extending through the top panel and connecting the first and second oblique tear lines.

11. The carton of claim 8, wherein the dispenser section extends into the top panel a length L, the carton has a length $L_C$, and wherein $L/L_C$ is at least 0.2.

12. The carton of claim 8, wherein the first end panel is connected to the first side panel at a first diamond corner and connected to the second side panel at a second diamond corner.

13. The carton of claim 1, wherein the first end panel is connected to the first side panel at a first diamond corner and connected to the second side panel at a second diamond corner.

14. The carton of claim 13, wherein the dispenser pattern extends in at least a portion of the first diamond corner.

15. The carton of claim 13, wherein the bottom panel is wider than the top panel.

16. The carton of claim 15, wherein the dispenser pattern comprises a plurality of opening tear lines defining an opening section in the first upper side panel, the opening section having a width measured along a length of the first side panel that is at least about 0.4 times the length of the first side panel.

17. The carton of claim 15, wherein the dispenser pattern comprises a plurality of opening tear lines defining an opening section in the second upper side panel, the opening section having a width measured along a length of the second side panel that is at least about 0.4 times the length of the second side panel.

18. The carton of claim 1, wherein the dispenser pattern comprises a plurality of opening tear lines defining an opening section in the first upper side panel, the opening section having a width measured along a length of the first side panel that is at least about 0.4 times the length of the first side panel.

19. The carton of claim 1, wherein the dispenser pattern comprises a plurality of opening tear lines defining an opening section in the second upper side panel, the opening section having a width measured along a length of the second side panel that is at least about 0.4 times the length of the second side panel.

20. A method of opening a carton according to claim 1, comprising:

pulling the dispenser section so that substantially all of the first upper side panel is at least partially torn away from a remainder of the carton;

pulling the dispenser section so that substantially all of the top panel is at least partially torn away from the remainder of the carton; and pulling the dispenser section so that a portion of the second side panel is at least partially torn away from the remainder of the carton.

21. The carton of claim 1, wherein each of the first side end flaps of the first and second end panels further comprises a first lower side end flap connected to the first lower side panel at an oblique fold line, wherein each of the oblique fold lines extends from an end of a respective one of the first and second longitudinal tear lines, each oblique fold line extending at an angle with respect to the respective one of the first and second longitudinal tear lines.

22. The carton of claim 1, wherein each of the first and second end panels comprises a lower portion extending inwardly from the bottom panel and an upper portion extending vertically from the respective lower portion to the top panel, the upper portions of the first and second end panels extending perpendicular to the top panel.

23. A blank for forming a carton, the blank comprising:

a bottom panel;

a first side panel comprising a first lower side panel and a first upper side panel foldably connected to the first side panel, the first upper side panel being foldably connected to the first lower side panel at a first fold line extending across the first side panel;

a second side panel comprising a second lower side panel and a second upper side panel foldably connected to the second side panel, the second upper side panel being foldably connected to the second lower side panel at a second fold line extending across the second side panel;

a top panel;

a plurality of first end flaps extending along a first marginal area of the blank for closing a first end of the carton, the plurality of first end flaps comprising a first side end flap comprising at least a first upper side end flap foldably connected to the first upper side panel, a second side end flap comprising at least a second upper side end flap foldably connected to the second upper side panel, a top end flap foldably connected to the top panel, and a bottom end flap foldably connected to the bottom panel;

a plurality of second end flaps extending along a second marginal area of the blank for closing a second end of the carton, the plurality of second end flaps comprising a first side end flap comprising at least a first upper side end flap foldably connected to the first upper side panel, a second side end flap comprising at least a second upper side end flap foldably connected to the second upper side panel, a top end flap foldably connected to the top panel, and a bottom end flap foldably connected to the bottom panel;

features for forming a first handle at the first end of the carton, the features comprising a first handle opening in at least one of the plurality of first end flaps; and features for forming a second handle at the second end of the carton, the features comprising a second handle opening in at least one of the plurality of second end flaps, wherein a dispenser pattern defines a dispenser section at least in the first upper side panel and the second upper side panel, wherein the dispenser section comprises all of the top panel, wherein the dispenser pattern comprises a first transverse tear line extending along and collinear with the first fold line and a second transverse tear line extending along and collinear with the second fold line, each of the first and second transverse tear lines at least partially defining an edge of the dispenser section, and each one each of the first and second transverse tear lines extending across the respective first and second side panels from the first marginal area of the blank to the second marginal area of the blank wherein the dispenser pattern further comprises a first longitudinal tear line and a second longitudinal tear line, the first and second longitudinal tear lines extending from a respective end of the first transverse tear line to a respective end of the second transverse tear line, wherein the first upper side end flap, the top end flap, and the second upper side end flap of the plurality of first end flaps are foldably connected to the respective first upper side panel, top panel, and second upper side panel along the first longitudinal tear line, and wherein the first upper side end flap, the top end flap, and the second upper side end flap of the plurality of second end flaps are foldably connected to the respective first upper side panel, top panel, and second upper side panel along the second longitudinal tear line.

24. The blank of claim 23, wherein the dispenser pattern comprises a plurality of opening lines defining an opening section in the first upper side panel.

25. The blank of claim 24, wherein the opening section abuts the first fold line.

26. The blank of claim 23, wherein the dispenser pattern comprises a plurality of opening lines defining an opening section in the second upper side panel.

27. The blank of claim 26, wherein the opening section is adjacent to the top panel.

28. The blank of claim 26, wherein the dispenser pattern comprises a first longitudinal tear line extending adjacent to the first marginal area and a second longitudinal tear line extending adjacent to the second marginal area.

29. The blank of claim 26, wherein a diamond corner is formed in the blank at each end of the first side panel.

30. The blank of claim 23, wherein the dispenser section is further defined in the first end panel.

31. The blank of claim 30, wherein the dispenser pattern comprises a first oblique tear line extending through the first side panel and a second oblique tear line extending through the second side panel.

32. The blank of claim 31, wherein the dispenser pattern comprises a top tear line extending through the top panel and connecting the first and second oblique tear lines.

33. The blank of claim 30, wherein the dispenser section extends into the top panel a length L, the top panel has a length $L_C$, and wherein $L/L_C$ is at least 0.2.

34. The blank of claim 30, wherein a diamond corner is formed in the blank at each end of the first side panel.

35. The blank of claim 23, wherein a diamond corner is formed in the blank at each end of the first side panel.

36. The blank of claim 35, wherein the dispenser pattern extends in at least a portion of the first diamond corner.

37. The blank of claim 35, wherein the bottom panel is wider than the top panel.

38. The blank of claim 37, wherein the dispenser pattern comprises a plurality of opening tear lines defining an opening section in the first upper side panel, the opening section having a width measured along a length of the first side panel that is at least about 0.4 times the length of the first side panel.

39. The blank of claim 37, wherein the dispenser pattern comprises a plurality of opening tear lines defining an opening section in the second upper side panel, the opening section having a width measured along a length of the second side panel that is at least about 0.4 times the length of the second side panel.

40. The blank of claim 23, wherein the dispenser pattern comprises a plurality of opening tear lines defining an opening section in the first upper side panel, the opening section having a width measured along a length of the first side panel that is at least about 0.4 times the length of the first side panel.

41. The blank of claim 23, wherein the dispenser pattern comprises a plurality of opening tear lines defining an opening section in the second upper side panel, the opening section having a width measured along a length of the second side panel that is at least about 0.4 times the length of the second side panel.

42. The blank of claim 23, wherein the first side end flap of the plurality of first end flaps further comprises a first lower side end flap connected to the first lower side panel at a first oblique fold line and the second side end flap of the plurality of first end flaps further comprises a second lower side end flap connected to the second lower side panel at a second oblique fold line, wherein each of the first and second oblique fold lines extends from a respective end of the first longitudinal tear lines, each oblique fold line extending at an angle with respect to the respective one of the first and second longitudinal tear lines.

* * * * *